US007081079B2

(12) United States Patent
Baclija et al.

(10) Patent No.: US 7,081,079 B2
(45) Date of Patent: Jul. 25, 2006

(54) ROTARY OBJECT FEEDER

(75) Inventors: Petar Baclija, Toronto (CA); Peter Guttinger, Milton (CA); Tony Spadafora, Ancaster (CA); Stephan Willem Anthonius Ammerlaan, Volkel (NL); Albertus Theodorus Anthonius Mathijssen, Nijmegen (NL)

(73) Assignee: Langen Packaging Inc., Ontario (CA)

( * ) Notice: Subject to any disclaimer, the term of this patent is extended or adjusted under 35 U.S.C. 154(b) by 206 days.

(21) Appl. No.: 10/679,448

(22) Filed: Oct. 7, 2003

(65) Prior Publication Data

US 2005/0008470 A1 Jan. 13, 2005

(30) Foreign Application Priority Data

Jul. 9, 2003 (CA) ..... 2434832

(51) Int. Cl.
*B31B 1/80* (2006.01)

(52) U.S. Cl. ..... 493/315; 493/317; 493/318

(58) Field of Classification Search ..... 493/315, 493/317, 318, 313, 71; 271/95, 104; 414/797, 414/797.7, 742
See application file for complete search history.

(56) References Cited

U.S. PATENT DOCUMENTS 5,061,231 A 10/1991 Dietrich et al.
5,215,515 A * 6/1993 Bershadsky ..... 493/315
5,411,464 A * 5/1995 Calvert et al. ..... 493/315
5,415,615 A * 5/1995 Culpepper ..... 493/315
5,456,570 A * 10/1995 Davis et al. ..... 414/742
5,603,599 A * 2/1997 Wesslen et al. ..... 414/411
5,662,577 A * 9/1997 Reuteler ..... 493/315
5,715,657 A * 2/1998 Mondani et al. ..... 53/457
5,910,078 A 6/1999 Guttinger et al.
5,928,123 A * 7/1999 Davis, Jr. ..... 493/316
5,997,458 A 12/1999 Guttinger et al.
6,101,787 A * 8/2000 Brintazzoli et al. ..... 53/389.1
6,383,123 B1 * 5/2002 Ehring et al. ..... 493/315

FOREIGN PATENT DOCUMENTS

CA 1019780 10/1977

* cited by examiner

*Primary Examiner*—Sameh H. Tawfik
(74) *Attorney, Agent, or Firm*—Antonelli, Terry, Stout and Kraus, LLP.

(57) ABSTRACT

A rotary object feeder comprises a sun member having a sun axis and being rotatable about a sun axis of rotation at a rotational speed of W1. The feeder also has a planetary member mounted for connection to the sun member, the planetary member having a planetary axis located at a constant distance X from the sun axis. The planetary member is rotatable about the planetary axis of rotation and is also mounted for rotation around the sun axis with the sun member. The planetary member is rotated about the planetary axis at a rotational speed of W3 which is opposite in direction to W1. N pick-up members are mounted on the planetary member, where N is an integer greater than or equal to 3. The pick up members are rotatable with the planetary member about the planetary axis and rotate with the planetary member around the sun axis. The pick-up members are driven about the planetary axis and the sun axis such that the pick-up locations of the pick-up members follow a common cyclical path having M apexes, wherein M=(N+1), and W3 is equal in magnitude to (M/N)×W1.

29 Claims, 21 Drawing Sheets

4 POINTS/3 HEADS

5 POINTS/4 HEADS

6 POINTS/5 HEADS

7 POINTS/6 HEADS

ROTARY OBJECT FEEDER

TECHNICAL FIELD

The present invention relates to a rotary object feeder that can feed an object along a cyclical path or a part thereof.

BACKGROUND OF THE INVENTION

Rotary object feeders having multiple pick-up heads are known. Having a feeder with three or more heads will provide improved efficiencies and speeds in the handling of objects. For example, U.S. Pat. No. 5,910,078 issued Jun. 8, 1999 to Guttinger et al., the contents of which are hereby incorporated herein by reference, discloses such a rotary feeder.

The rotary feeder in the aforementioned patent employs a plurality of pick-up heads, each pick-up head being driven by separate shafts and gearing mechanism interconnected to a central drive mechanism to provide for rotation which defines a cyclical path for each of the pick-up heads.

Having to provide separate drive shafts and gearing mechanisms for each pick-up head is particularly problematic for rotary feeders that have three or more separate pick-up heads, each head being capable of handling an object.

It is therefore desirable to improve the construction of rotary feeders having three or more pick-up heads.

SUMMARY OF INVENTION

According to one aspect of the present invention, there is provided a rotary object feeder comprised of: a sun member which has a sun axis and is rotatable about the sun axis of rotation; a sun drive mechanism for driving the sun member in rotation about the sun axis at a rotational speed of W1; a planetary member, which has a planetary axis that is substantially parallel to the sun axis located at a constant distance X from the sun axis, mounted for connection to the sun member, the planetary member is rotatable about the planetary axis of rotation and also is mounted for rotation around the sun axis with the sun member; a planetary drive mechanism for rotating the planetary member about the planetary axis at a rotational speed of W3 which is opposite in direction to W1; and N pick-up members mounted on the planetary member, where N is an integer greater than or equal to 3. The pick-up members have pick-up locations at a common radius from the planetary axis. The pick up members are rotatable with the planetary member about the planetary axis and rotates with the planetary member around the sun axis. Each of the pick-up members pick-up, hold and release an object at respective pick-up locations. Each pick-up location on the pick-up member is a fixed distance equal to L from the planetary axis. The pick-up members are driven about the planetary axis and the sun axis such that the pick-up locations of the pick-up members follow a common cyclical path which has M apexes, wherein M=(N+1), and W3 is equal in magnitude to (M/N)×W1.

According to another aspect of the present invention, there is provided a method of feeding an object along at least part of a cyclical path having M apexes. The method comprises: rotating the object about a planetary axis at a rotational speed of W3; rotating the planetary axis along with the object about a sun axis substantially parallel to the planetary axis, at a rotational speed of W1 in an opposite direction to W3 at a constant distance X from the sun axis; and, picking up and releasing the object along the path at locations that are a fixed distance equal to L from the planetary axis, wherein W3 is equal in magnitude to (M/(M−1))×W1, and M≧=4.

According to another aspect of the present invention, there is provided an apparatus for feeding an object along at least part of a cyclical path which has M apexes. The apparatus comprises: means for rotating the object about a planetary axis at a rotational speed of W3; means for rotating the planetary axis along with the object about a sun axis substantially parallel to the planetary axis, at a rotational speed of W1 in an opposite direction to W3 at a constant distance X from the sun axis; and, means for picking up and releasing the object along the path, at locations that are a fixed distance equal to L from the planetary axis, wherein W3 is equal in magnitude to (M/(M−1))×W1, and M≧=4.

According to another aspect of the present invention, there is provided a system for feeding containers into a carton holding receptacle comprised of: a conveyor system having a carton holding receptacle for receiving and holding a container; a container magazine which holds a plurality of containers and has a container release position, at which containers can be retrieved from the container magazine; and, a container feeder for retrieving a container from the container magazine and thereafter releasing the container into the receptacle on the conveyor system. The feeder comprises: (a) a sun member which has a sun axis and is rotatable about the sun axis of rotation; (b) a sun drive mechanism for driving the sun member in rotation about the sun axis at a rotational speed of W1; (c) a planetary member, which has a planetary axis that is substantially parallel to the sun axis at a constant distance X from the sun axis, mounted for connection to the sun member, the planetary member is rotatable about the sun axis of rotation and also is mounted for rotation around the sun axis with the sun member; (d) a planetary drive mechanism for rotating the planetary member about the planetary axis at a rotational speed of W3 which is opposite in direction to W1; and, (e) N pick-up members are mounted on the planetary member and have pick-up locations at a common radius from the planetary axis. The hub member is rotatable with the planetary member about the planetary axis and rotates with the planetary member around the sun axis. Each of the pick-up members pick-up, hold and release a container at respective pick-up locations. Each pick-up location on the pick-up member is a fixed distance equal to L from the planetary axis. The pick-up members are driven about the planetary axis and the sun axis such that the pick-up locations of the pick-up members follow a common cyclical path having M apexes, wherein M=(N+1), and W3 is equal in magnitude to (M/N)×W1.

BRIEF DESCRIPTION OF THE DRAWINGS

In drawings that illustrate by way of example only, preferred embodiments of the present invention.

DETAILED DESCRIPTION

Figure 1:
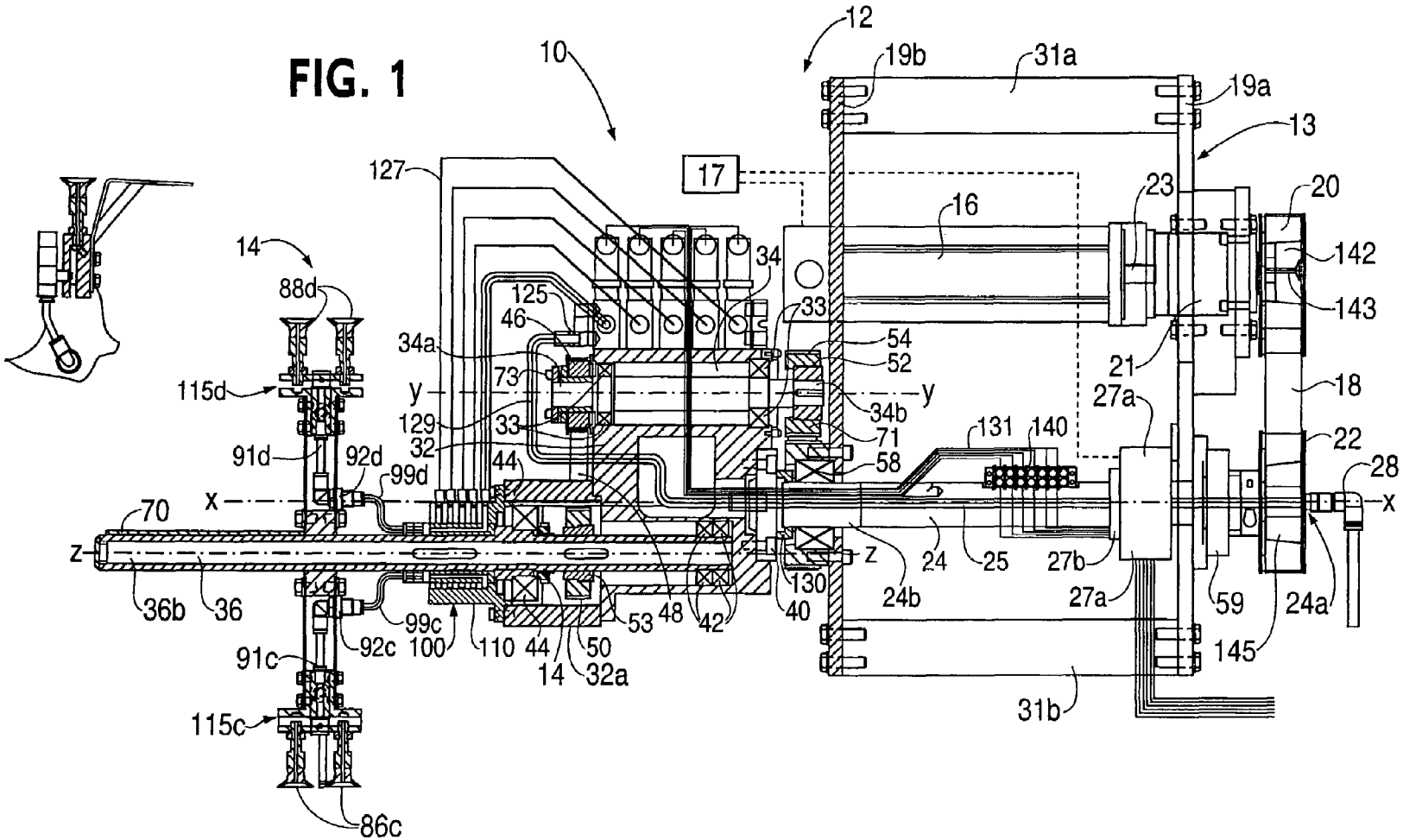
FIG. 1 is a top plan cross-sectional view through a five head rotary feeder in accordance with an embodiment of the invention.

With reference to FIG. 1, a rotary object feeder generally designated 10 and which is suitable for picking up, rotating and releasing an object (not shown in FIG. 1) is illustrated. Feeder 10 can be used with objects such as for example a carton or other container, and can move the objects about a cyclical path or a part thereof. Rotary feeder 10 is, as will be explained hereafter, adapted to pick-up and release the object at positions about the cyclical path.

With reference to FIGS. 1, 3, 4 and 5, rotary feeder 10 comprises a driving mechanism generally designated 12 and a pick-up member (e.g. suction cup) wheel generally designated 14. Drive mechanism 12 includes a frame generally designated 13 to which is mounted a servo-motor 16. Servo-motor 16 has a shaft 23 which can rotate at a relatively high speed of rotation. Gearing is provided for the servo-motor so that the servo-motor shaft 23 which acts through a reducer 21 will drive a pulley 20 which in turn is connected to a drive belt 18. Reducer 21 comprises a series of planetary gears configured to provide the necessary reduction in speed of rotation from shaft 23 to drive pulley 20. In the example shown in FIGS. 1 and 2, reducer effects a reduction from a shaft 23 rotational speed of 3000 rpm, to pulley 20 rotational speed of 600 rpm (i.e. 5:1 reduction). Pulley 20 is mounted on a bushing 142, carried on an output shaft 143 from reducer 21. Servo-motor 16 can be controlled by a Programmable Logic Controller, PLC 17 to control the rotation of drive pulley 20. The servo-motor shaft 23 and thus drive pulley 20 may be driven at a constant and/or variable speed, depending upon the requirements of the feeder 10.

Drive belt 18 is also interconnected to drive a sun shaft drive pulley 22, which is mounted and fixedly connected to a rear end portion 24*a* on a bushing attached to a rear portion 24*a* of a main sun shaft 24. Sun shaft 24 is cylindrical and has a hollow centrally longitudinally extending channel 25 which, as will be explained hereinafter, is for the supply of pressurized air to be delivered to the suction cup wheel 14.

Sun shaft 24 is mounted for rotation on, and passes between, spaced mounting plates 19*a* and 19*b*, which are interconnected with connecting bars 31*a*, 31*b*, and form part of the support frame 13. Sun shaft 24 has rear and front portions 24*a* and 24*b* extending beyond the outward facing surfaces of the discs 19*a*, 19*b*. Sun shaft 24 can rotate and be driven about its longitudinal axis X—X relative to the frame 13 at a rotational speed of W1 by drive belt 18. Sun shaft 24 is supported for rotation about axis X—X at a forward end 24*b* on bearings 58 mounted in an associated bearing housing formed in sun pulley 56. A circular spacer 130 surrounds sun shaft end 24*b* and is mounted there to prevent axial movement of shaft 24. Toward a rear end 24*a* of sun shaft 24, the sun shaft is supported for the rotation about axis X—X on bearings held in a bearing housing 59 (see FIG. 1).

Interconnected at the rear end portion 24*a* of sun shaft 24 and in connection with channel 25 is a rotary joint 28. Rotary joint 28 has a central supply channel in connection with, and for passing pressurized air to, sun shaft channel 25, from a source of pressurized air (not shown) which can be connected thereto. Rotary joint 28 may be, for example, the device produced by PISCO™ under Model No. RHL-8-02. The sun shaft 24 can rotate while being connected to rotary joint 28, the latter remaining fixed relative to frame 13.

Figure 5:
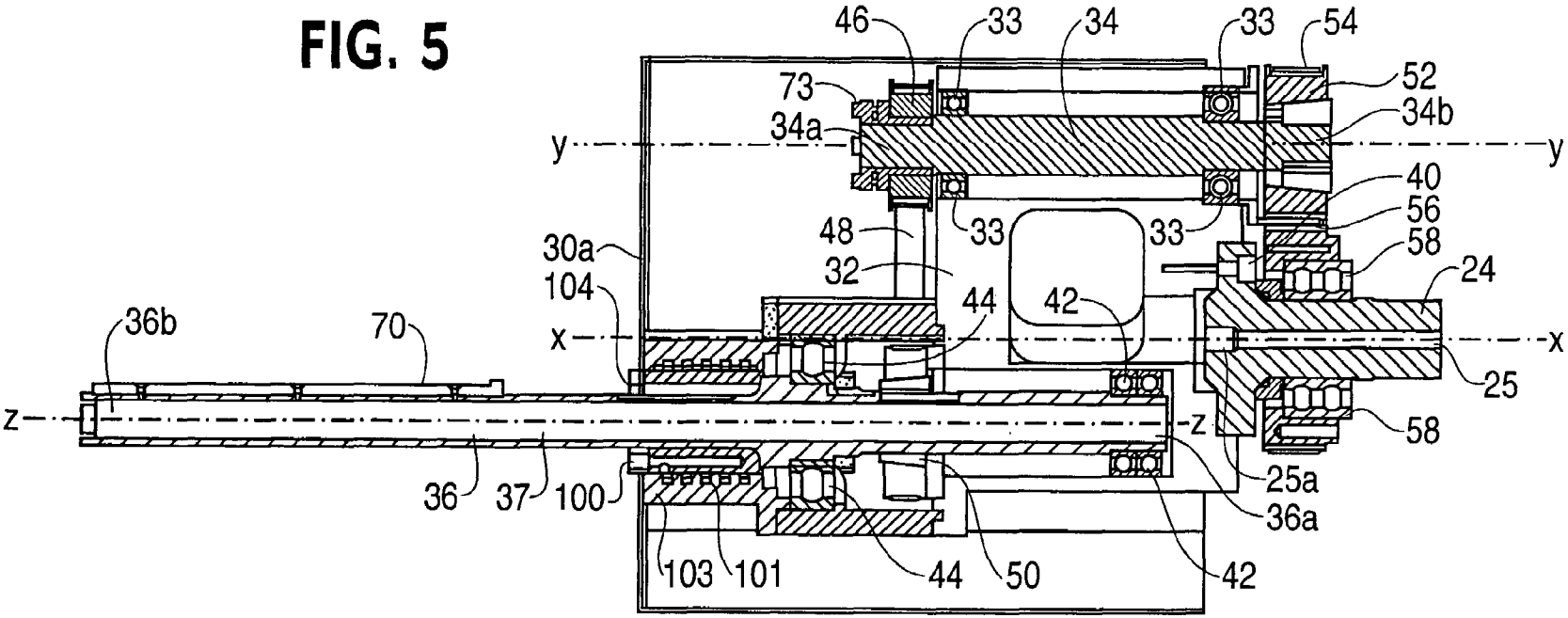
FIG. 5 is an enlarged cross-sectional view at 5—5 in FIG. 3.

Fixedly mounted to the opposite front end 24*b* of sun shaft 24 is a housing generally designated 32. Thus, housing 32 rotates with sun shaft 24 at rotational speed W1 about longitudinal sun axis X—X. Sun shaft 24 is bolted at its forward end portion 24*b* to housing 32 with bolts 40 (one of which is shown in FIG. 5) so that sun shaft 24 will provide the main drive source for the other moving components of feeder 10.

Mounted for rotation about its own axis Y—Y, within housing 32 on bearings 33 is an idler shaft 34. Idler shaft 34 is mounted generally parallel to sun shaft 24 and is held by the bearings 33. Idler shaft 34 will thus rotate with housing 32 as the housing rotates about sun axis X—X, and can also rotate on bearings 33 about its own idle axis Y—Y.

Also mounted within housing 32 is a planetary shaft 36 which may be mounted with its own planetary axis Z—Z spaced at an approximate angular position relative to sun axis X—X, 180 degrees apart from idler axis Y—Y. However, this 180 degree angular spacing between axis Y—Y and axis Z—Z, is not essential, but assists in the physical arrangement of the components. The actual relative positioning of planetary shaft 36 to idler shaft 34 is usually dependent at least in part on the physical constraints imposed by mounting these components and their associated components on housing 32. Planetary axis Z—Z is also generally parallel to sun axis X—X. Planetary shaft 36 will rotate with housing 32 and idler shaft 34 around sun axis X—X as the housing is rotated by sun shaft 24. Planetary shaft 36 is also rotatable about its own longitudinal planetary axis Z—Z on bearings 42 and 44. Bearing 44 is locked in place with bearing housing portion 32*a* and outer housing 110 (see FIGS. 1 and 11). Bearing 44 is fixedly attached to shaft 36 with a bearing locking nut 141.

Fixedly attached at a forward end 34*a* of idler shaft 34 is a pulley 46, which is fixedly attached by means of an ETP bushing to idler shaft 34, and which clamps pulley 46 to shaft 34. The ETP bushing is also used to adjust suction cup alignment. ETP bushing 73 clamps pulley 46 against idler shaft 34 to hold it in place, but can be released so that the rotational position of pulley 46 can be adjusted relative to shaft 34. Thus the rotational position of shaft 34 can be adjusted relative to the rotational position of shaft 36. However, when set in the proper position, and with ETP bushing 73 clamped down on shaft 34, pulley 46 rotates with idler shaft 34. By way of further explanation as to how the initial start position is appropriately adjusted, with reference also to FIGS. 11 and 12C (position (i)), first the planetary shaft 36 can be moved about sun axis X—X with housing 32, so that the planetary shaft 36 is in the 6 o'clock position shown relative to sun axis X—X. With the ETP bushing 73 released, planetary shaft 36 can be rotated about its own axis Z—Z independent of idler shaft 34 and housing 32, which remain at their setting positions. Planetary shaft 36 is then rotated about its axis Z—Z so that one of the suction cup units 115 and associated sets of suctions cups 88 is also in the six o'clock position (see position (i) in FIG. 12C). Then the ETP bushing 73 can be locked in place and the positions of the components, including all the suction cups, will then have been properly set.

Pulley wheel 46 engages and is secured to a drive belt 48 which in turn is also interconnected to a pulley 50 which is fixedly attached to and around planetary shaft 36 at a middle portion of the shaft by means of a taper bushing 53.

Mounted at the opposite end portion 34*b* of idler shaft 34 to idler pulley wheel 46, is a pulley 52 which is fixedly attached with another taper bushing 71 to idler shaft 34. Thus, when pulley 52 rotates about axis Y—Y, idler shaft 34 is thereby rotated. Pulley 52 is engaged by a drive belt 54, which is also interconnected to a sun pulley 56. Sun pulley 56 is fixed relative to frame 13. Sun shaft 24 rotates within and passes through sun pulley 56 which as described above is mounted on bearings 58 and on bearings in bearing housing 59. Thus, as sun shaft 24 rotates about sun axis X—X, the idler shaft 34 as a whole, rotates around sun axis X—X like a planet around the sun. Additionally, the interconnection between sun pulley 56 which is fixed relative to frame 13, and pulley 52 acting through drive belt 54, causes planetary pulley 52 to rotate about axis Y—Y, thus rotating idler shaft 34 about its own longitudinal axis Y—Y at a rotational speed W2, and which is opposite in direction to W1.

Likewise, the rotation of idler shaft 34 at W2 about its axis Y—Y, driven by belt 54 and pulley 52, will cause idler pulley 46 to also rotate about axis Y—Y at rotational speed W2 and in the same direction. This in turn causes belt 48 to rotate, rotating planetary drive pulley 50 about planetary shaft axis Z—Z. Drive pulley 50, being fixed to planetary shaft 36, will thus in turn rotate planetary shaft 36 about its own axis Z—Z at a rotational speed W3, and in the same rotational direction as idler shaft 36 rotation W2, and in the opposite direction to the rotation of sun shaft 24 about its own axis X—X.

Figure 2:
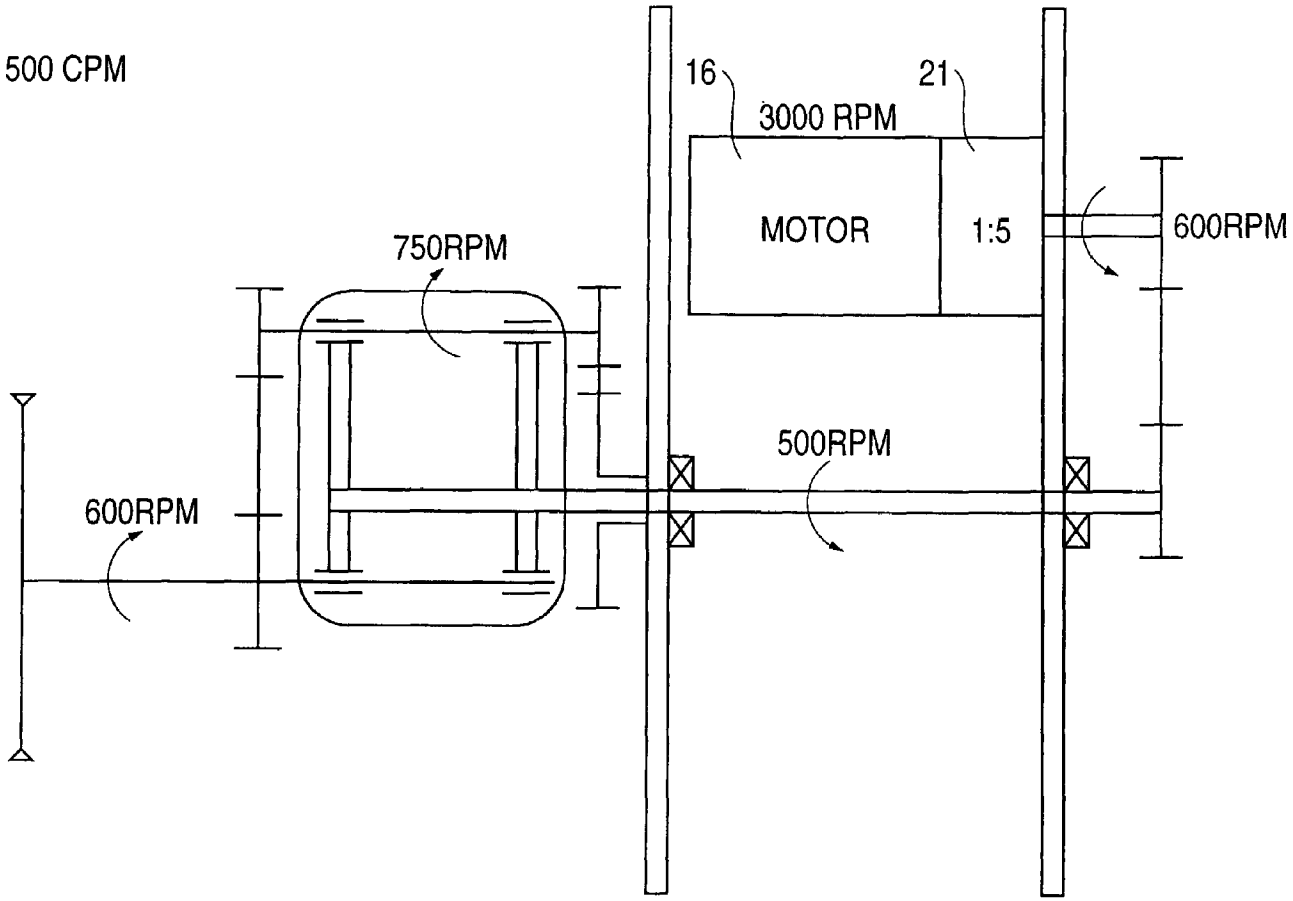
FIG. 2 is a schematic plan view of an example configuration of the feeder of FIG. 1 illustrating relative rotational speeds of components of the feeder.
Figure 6:
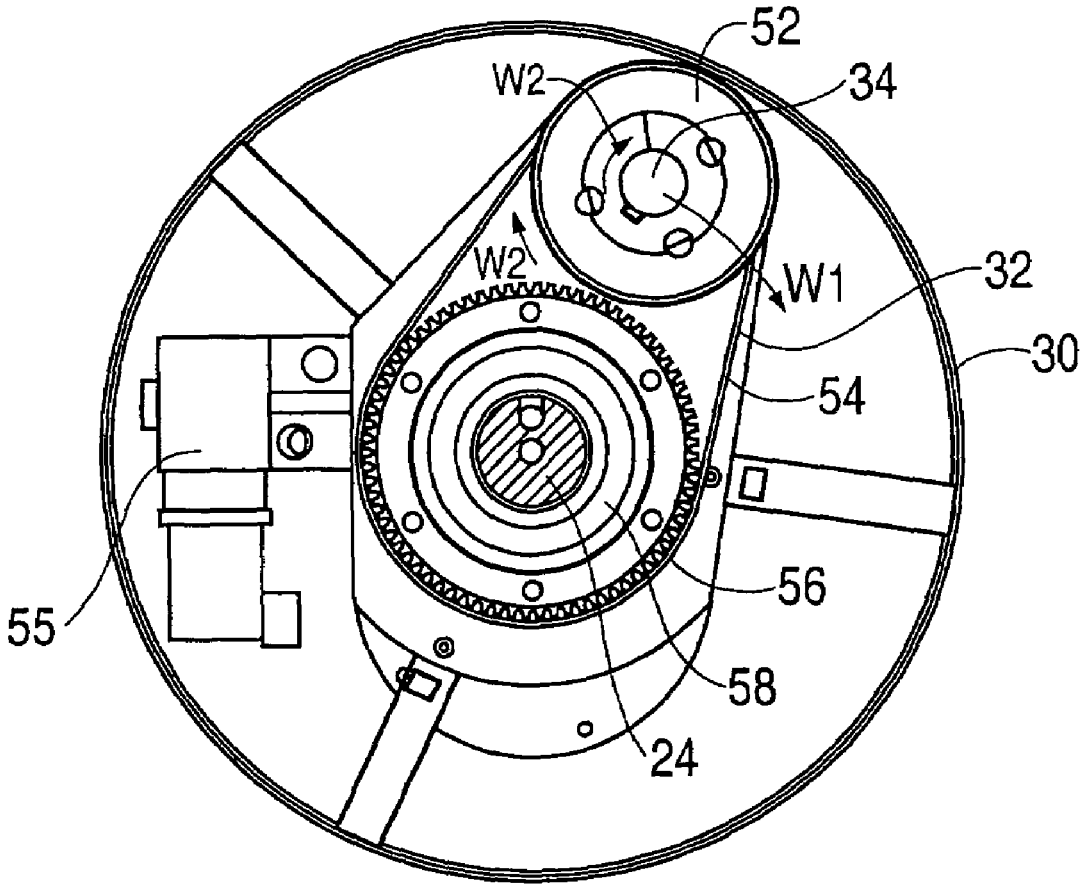
FIG. 6 is a rear cross-sectional view at 6—6 in FIG. 3.

It will be appreciated that as shown in FIG. 2, different gearing ratios can provide for different rotational speeds of the planetary shaft 36, idler shaft 34 and sun shaft 24 relative to each other. So for example as shown in FIG. 2, servomotor shaft 23 can be rotated at a constant speed of 3000 rpm and reduced by reducer 21 to rotate drive pulley 20 at 600 rpm. The ratio of the speeds of rotation between drive pulley 20 and sun shaft drive pulley 22 can be determined by selecting appropriate sized wheels (i.e. ratio of the diameters will determine the relative angular speeds), such that when drive pulley 20 rotates at 600 rpm, sun shaft 24 is rotated at 500 rpm (W1). The rotation of sun shaft drive pulley 22 and sun shaft 24 at 500 rpm, can again, by the selection of appropriate gear ratios, between sun pulley 56 and idler pulley 52 effect rotation of idler shaft 34 at a rotational speed W2 of 750 rpm, but it will rotate in the opposite direction to sun shaft 24 (see also FIG. 6).

Likewise, the gear ratio between idler pulley 46 and planetary drive pulley 50 can be provided such that planetary shaft 36 will rotate at a W3 of 600 rpm in the same direction as idler shaft 34. It will be appreciated that there will therefore be an absolute rotational speed of the planetary shaft in one direction, that is 20% greater than the rotational speed of the sun shaft 24.

As will be explained further hereinafter it has been discovered that by appropriate selection of the rotational speed of the planetary shaft 36 (W3) compared to the rotational speed of the sun shaft 24 (W1) as well as appropriate dimensions (as explained hereinafter) a suitable path having a number of apexes in the path can be provided.

Figure 11:
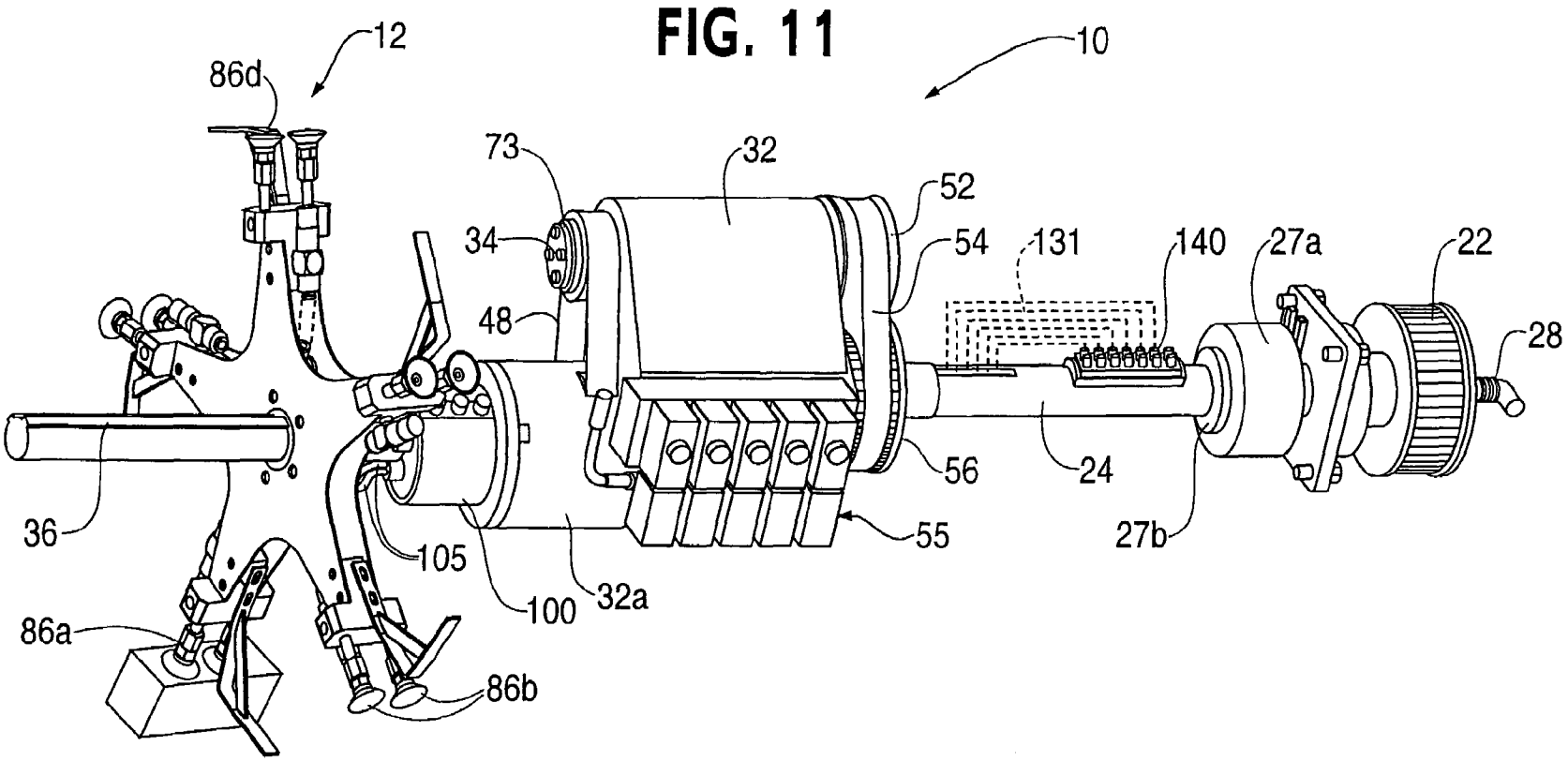
FIG. 11 is a front perspective view of most components of the feeder of FIG. 1, showing components thereof, but with the housing cover removed for clarity.

With reference to FIG. 11, depicting the example embodiment of the feeder of FIGS. 1 to 10, each of the five suction cup units or pick-up units 85 of the suction wheel 14, will travel through a path having six apexes.

Figure 3:
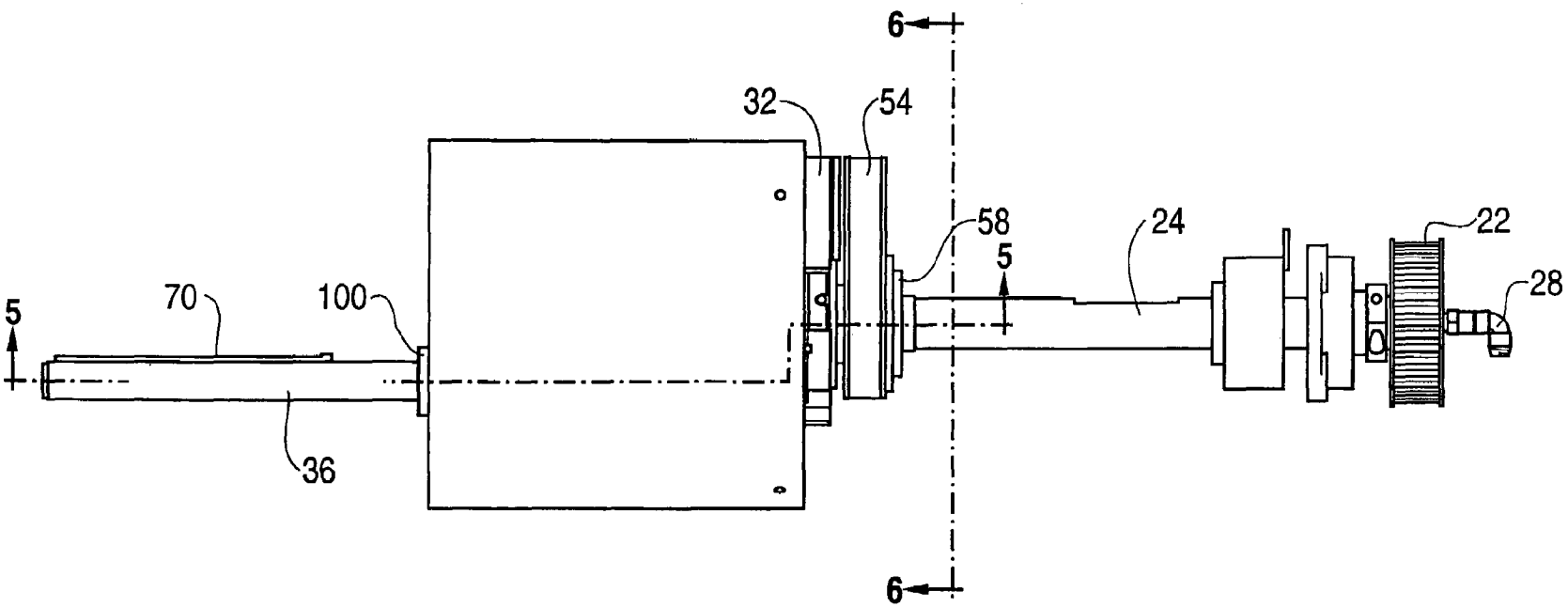
FIG. 3 is an elevation view of part of a feeder of FIG. 1.
Figure 4:
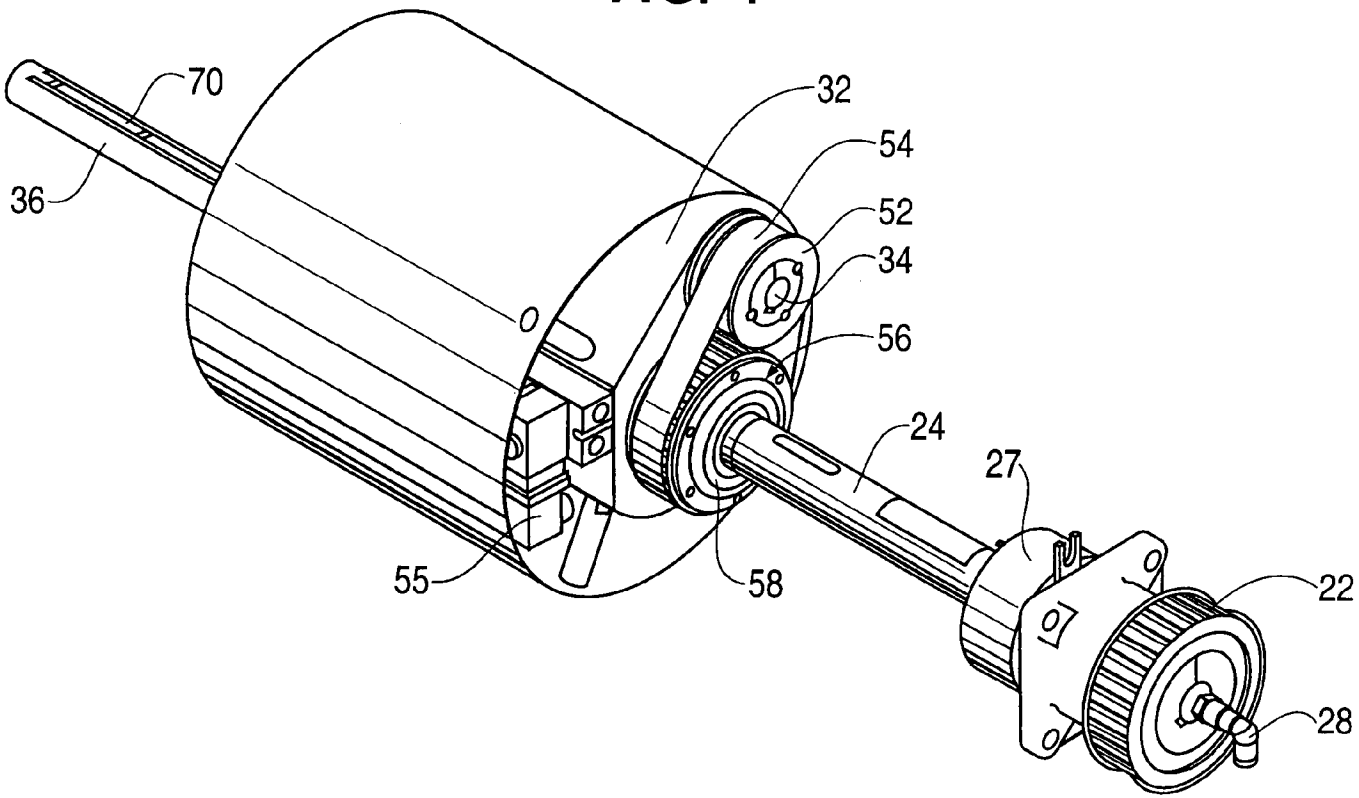
FIG. 4 is a rear perspective view of the part of the feeder as shown in FIG. 3.

Returning to a description of the components of the feeder 10, as shown clearly in FIGS. 3, 4 and 5, planetary shaft 36 has bolted against part of the surface of the shaft, key 70 which by slotting into an aperture in the hub 82 (see FIG. 8) of suction cup wheel 14 assists in affixing suction cup wheel 14 thereto. To ensure appropriate stability in two dimensions, there are actually two keys provided on planetary shaft 36 and two associated slots in hub 82 having an opening 83. One of the key, slot combinations is offset at an angle of about 72 degrees (360/5) which is close to the optimal offset of 90 degrees. By use of bolts 98 (see FIG. 9) in combination with the keys and slots, the suction cup wheel 14 can be securely and fixedly clamped onto planetary shaft 36 with both relative axial as well as relative rotational movement being prevented during feeder operation. Thus, suction cup wheel 14 will rotate about planetary axis Z—Z as planetary shaft 36 rotates about its own axis. Additionally, suction cup wheel 14 will rotate with planetary shaft 36 and housing 32 as they rotate in an orbit about sun axis X—X.

With reference now to FIGS. 7, 8, 9 and 10, the suction cup wheel, generally designated 14, is shown in detail. The basic frame for suction cup wheel comprises a back plate 94 and a front plate 96, each of which is configured in a five-pointed star shape having arms 84*a*, 84*b*, 84*c*, 84*d* and 84*e*. Plates 94 and 96 are positioned and bolted together in face-to-face relation and mounted with a hub 82 mounted and held therebetween.

Mounted proximate the end portion of each of arms 84*a–e* is a respective pick-up unit, generally designated 85*a–e*. Each pick-up unit 85*a–e* comprises a double suction cup holder 90*a–e* having a body portion 91*a–e* that is bolted between the respective plates of arms 84*a–e*. Each pick-up unit 85*a–e* also has a pair of suction cups 86*a–e* positioned in longitudinal side by side relation. Each pair of suction cups 86*a–e* is secured to its respective suction cup holder 90*a–e* with a hollow fitting member 87*a–e* and hexnut (not shown). Each double suction cup holder 90*a–e* has a channel 89*a–e* (see FIG. 9 for a representative example of a channel 89*a*) to permit the passage of air through the double pick-up suction cup holder through fitting 87*a–e* to suction cups 86*a–e*.

Also mounted to each of the suction cup holders 90*a–e*, is a respective carton rail 88*a–e* which is used to assist in holding a carton that is picked up and carried by the feeder. Each rail 88*a–e* pushes a carton and holds it between the carton receiving receptacles 230 (see FIG. 14) of the carton conveyor which conveys cartons from the feeder.

Mounted to each of the pick-up units 85*a–e* is a vacuum generator 80*a–e*. The vacuum generators each have an inlet aperture 91*a–e* to a source of pressurized air delivered by a hose, and an outlet aperture connected to each of the suction cup holders 90*a–e* and being in communication with channels 89*a–e* of holders 90*a–e*. Pressurized air delivered to each of the pick-up units 85 at inlets 91*a–e* can be converted to a vacuum using vacuum generators 80*a–e* such as PISCO™ Model No. VCH 10-01 6C. The vacuum generated can then be communicated to each of the suction cups 86*a–e* through the pick-up units 85*a–e*.

Figure 7:
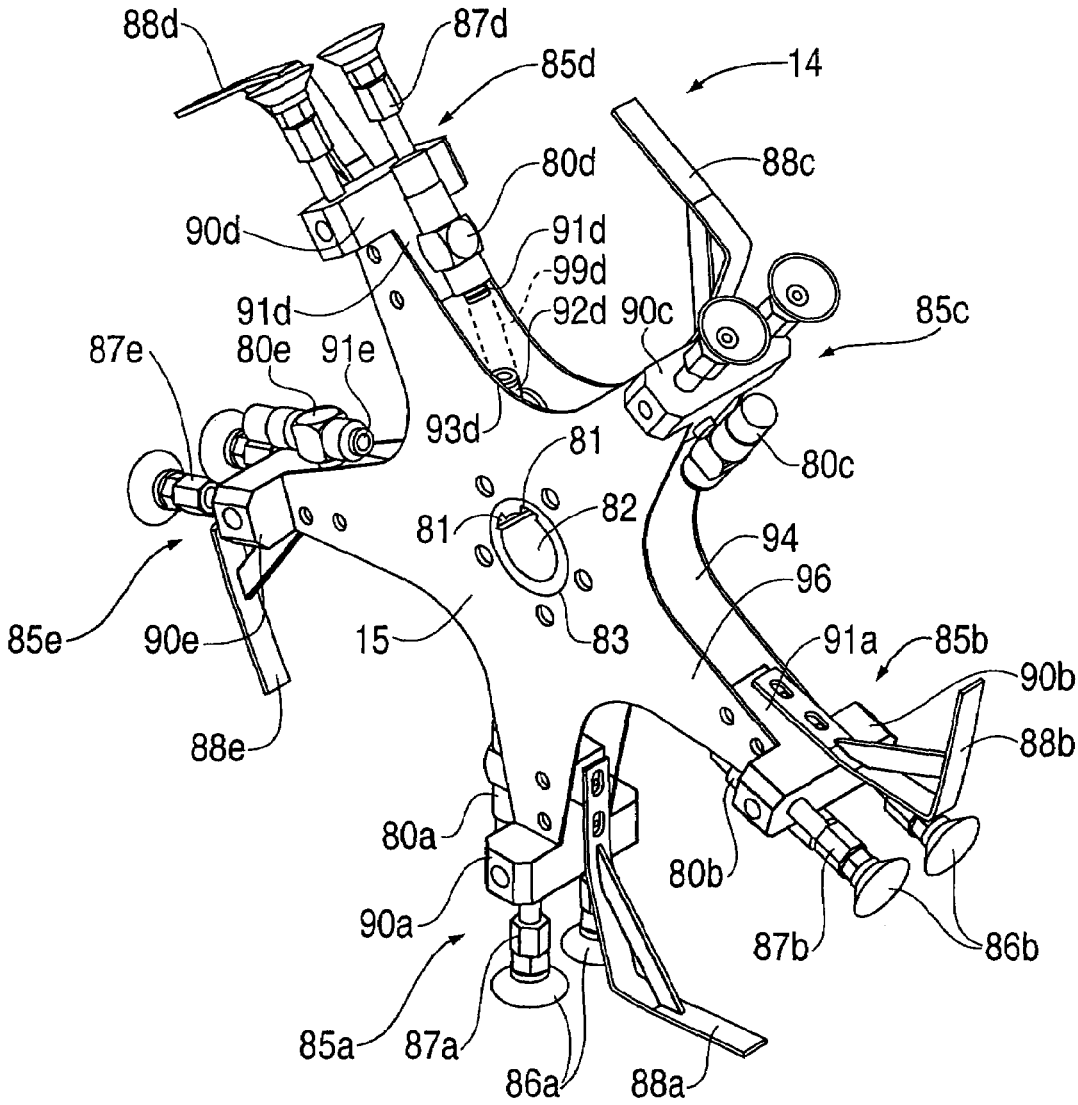
FIG. 7 is a front perspective view of another part of the feeder of FIG. 1.
Figure 8:
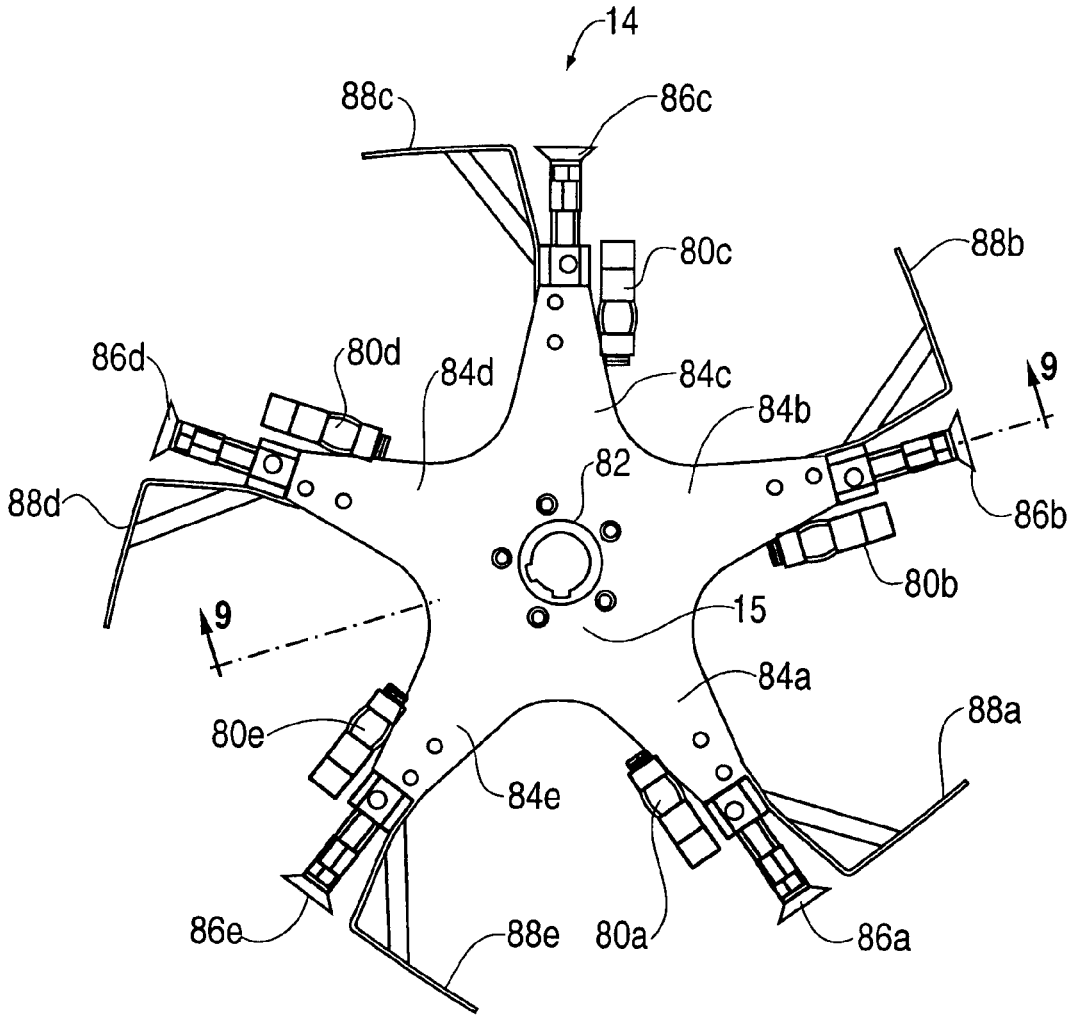
FIG. 8 is a front elevation view of the part of the feeder of FIG. 7.
Figure 9:
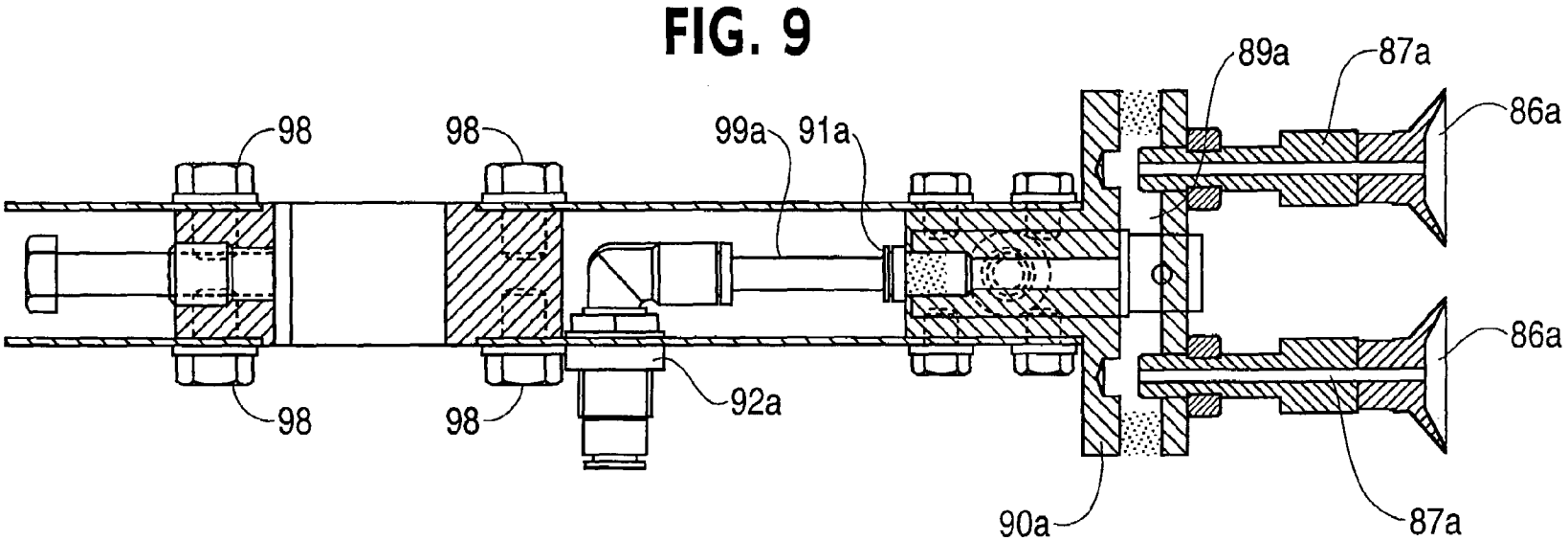
FIG. 9 is a cross-sectional view at 9—9 in FIG. 8.
Figure 10:
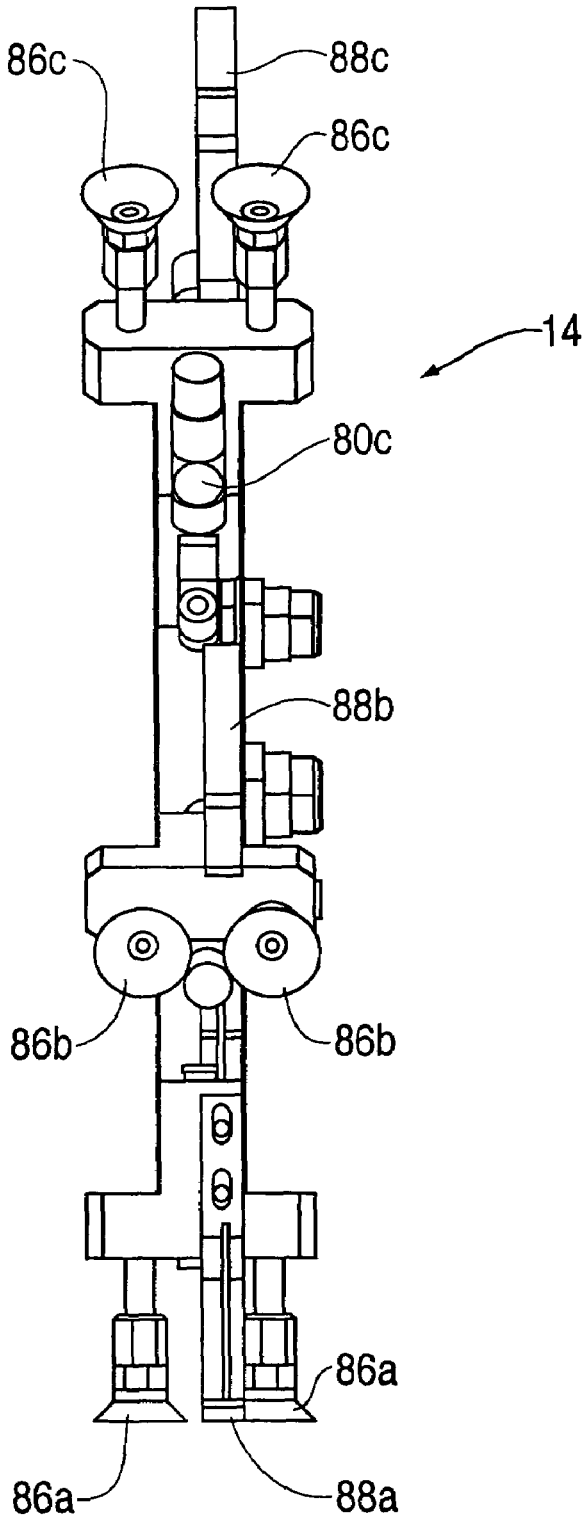
FIG. 10 is a side elevation view of the part of FIG. 8.

As best shown by way of example in FIG. 7 with respect to vacuum generator 80*d*, aperture inlet 91*d* is connected by way of hose 99*d* to the outlet 93*d* from a bulk head union elbow 92*d* such as PISCO™ Model PML6 which can be mounted between front plate 96 and rear plate 94. It will be appreciated that a bulk head union elbow 92*a–e* is provided for connection to each of the vacuum generators 80*a–e*.

As front cover 30*a* has an opening through which the front extension portion of planetary shaft 36 extends, a sealing multiple O-ring device 100 is provided that permits the rotation of the shaft 36 but which permits passage of five separate air channels from hoses (see FIG. 1) which are stationary with respect to the housing 32 into the shaft 36 so as to rotate with shaft 36 relative to housing 32. O-ring device 100 permits the passage of the pressurized air supply in five separate channels delivered from valve stack 55, but also provides a suitable seal. Such an O-ring device 100 can comprise an outer housing 110 holding multiple concentrically configured O-rings 101 mounted one inside the other to create a rotary swivel type connection. In device 100, channels are formed linking the outer housing 110 (which is stationary with respect to housing 32) with an inner cylinder which rotates with shaft 36. Air passages or channels that pass to the outer housing 110 can then continue into the inner cylinder while maintaining the separate channels or passages. Device 100 may be the PISCO™ Multi-Circuit Rotary Block RB-4-M5 or a similar device.

Returning to the suction cup wheel, separate hoses 105*a–e* are interconnected at outlets to the inlets of bulk head union elbows 92*a–e* and at their inlets are connected to the outlets from O-ring device 100 that surrounds and rotates with shaft 36. Hoses 127 have outlets that are connected to the inlets of O-ring device 100 and pass through housing 32 and are interconnected to the individual respective outlets of valve stack 55.

As shown in both FIGS. 4 and 11, also mounted within rotary feeder cover 30 and fixedly mounted to housing 32 for rotation therewith, is stacked arrangement of valves 55 such as MAC™ Valve Stack Model 187B-871JB. This stacked arrangement of valves has a common inlet and has a manifold structure whereby pressurized air delivered to the valve stack 55 can be divided into five separate channels, each channel being controlled by a valve. Thus pressurized air delivered through channel 25 of sun shaft 24 is fed from channel end portion 25*a* by way of a hose 129 connected to the end of channel 25 of shaft 24, and at its other end is connected into the inlet aperture 125 of valve stack 55. Each of the outlets of valve stack 55 is connected to one of the five separate hoses 127 that deliver pressurized air to each of the pick-up units 85*a–e* as described above. The flow of pressurized air to each of the five channels and associated hoses, can be controlled by the valve stack 55 which itself can be controlled by PLC 17. Valve stack 55 can be interconnected electronically to the PLC 17 or other controlling device for the feeder which can turn on and off the flow independently to each of the five channels.

In summary, pressurized air delivered from an air source passes through rotary joint 28 into channel 25 of sun shaft 24 and then via a hose 129 into valve stack 55. Pressurized air received in valve stack 55 is directed by the valve stack 55 to the plurality of five separate hoses 127 to deliver pressurized air through the hoses that pass through O-ring device 100 and rotate with planetary shaft 36. Each of the hoses 105 passing out of O-ring device 100 and into the suction cup wheel 14 is interconnected to an inlet of one of the union elbow units 92*a–e*. Pressurized air then passes through hoses 99*a–e* to each of the vacuum generators 80*a–e* which then in communication through channels 89 and fittings 87 produces a vacuum at suction cups 86*a–e*. By controlling valve stack 55, PLC can turn on and off the suction at each of the cups 86*a–e* as desired, as the cups move along their path.

It should be noted that the operation of turning on and off the valves-selectively by the operation of PLC 17 interplays with a position-detecting or sensing apparatus which can detect the position of at least one location of the suction cup wheel 14 as it moves throughout its path. Examples of the type of location-sensing device that can be used are disclosed in U.S. Pat. No. 5,997,458, issued Dec. 7, 1999 to Guttinger et al., the contents of which are hereby incorporated herein by reference. An encoder is used to determine the position of each head. The encoder is coupled to the feeder such that one revolution of the planetary shaft 36 results in one revolution of the encoder. In that way, each head can be tracked in a 360 degree cycle. The points at which the vacuum is turned ON and OFF will typically be the same for all heads, but they are delayed by factors of 72 degree given that 5 heads are present (5×72 degrees=360 degrees). If the first head is properly timed to the encoder then it follows that all other heads will be properly timed as well. The encoder provides the rotational position of the planetary shaft 36 to the PLC 17 so it can properly drive valve stack 55.

To enable PLC to communicate with stack 55 and to otherwise provide power to operate valve stack 55, a slip ring 27 is mounted on shaft 24 and provides means for electrical supply and other electrical control wires to pass from the outside environs where PLC 17 and power are located, into sun shaft 24 and to rotate therewith. This is accomplished by passing electrical power and signals by wires from the outer stator 27*a* which remains stationary relative to frame 13, through electrical brushes into the rotor 27*b*, which rotates with sun shaft 24. Electrical wires 131 then feed to a terminal 140 and the wires 131 can then be provided and pass into separate channel created (e.g. drilled) parallel to channel 25, be fed out of the end of shaft 24 and then be interconnected to valve stack 55.

Thus PLC 17 will cause servo-motor 16 to be driven at a desired or pre-selected speed of rotation of shaft 23. Reducer 21 will cause the speed of rotation of pulley 20 to be less but will drive pulley 20 which in turn drives belt 18. The movement of drive belt 18 will then cause sun pulley 22 to rotate shaft sun shaft 24 about sun axis X—X. Rotation of sun shaft 24 will in turn, cause housing 32 to rotate around sun axis X—X. Rotation of housing 32 around sun axis X—X in turn causes idler shaft 34 to move around sun axis X—X. The relative change in rotational position of idler shaft and pulley 52 relative to stationary pulley 56, will cause drive belt 54 to rotate pulley 52 around idler axis Y—Y. This in turn results in planetary pulley 46 being rotated around axis Y—Y. Pulley 46, being interconnected to drive belt 48 will then in turn drive pulley 50, causing it to rotate around planetary axis Z—Z. Rotation of pulley 50 around axis Z—Z then in turn causes planetary shaft 36 to rotate around axis Z—Z along with wheel 14. The result is that suction cups of the wheel are effected by two motions, the motion around axis X—X of the planetary shaft 36 and the wheel attached thereto, and the rotational motion around the planetary axis Z—Z.

With reference now to FIG. 11 in particular, the path of movement of suction cups 86*a–e* is shown in shadow outline. It will be appreciated that at any point along the path of a suction cup, its tangential velocity will be equal to the sum of the tangential velocities imparted by the rotation at W1 of planetary shaft 36 about sun axis X—X added to which is the tangential velocity in the opposite direction imparted by the suction cup rotating at rotational speed W3 about its planetary axis Z—Z.

In the embodiment of FIGS. 1 to 11, the suction cup wheel has been shown having five heads and follows a path with six apexes. The path is accomplished by ensuring that W3 is equal to −1.2W1. The path of each of the pick-up units and their suction cups through at least part of the entire sequence of movement of a suction cup from one apex to the next is shown in the movement sequence diagram of FIG. 12C.

It has been discovered that a suitable path can be provided for all heads of a multiple head feeder if the following conditions are met:

Where: M is the integer number of apexes in the path and is greater or equal to three; and N is the integer number of head units of the Suction Cup wheel Then: M must be equal to N+1

Additionally, W3 equals [M/N] times W1 and be in the opposite direction of rotation.

Figure 13A:
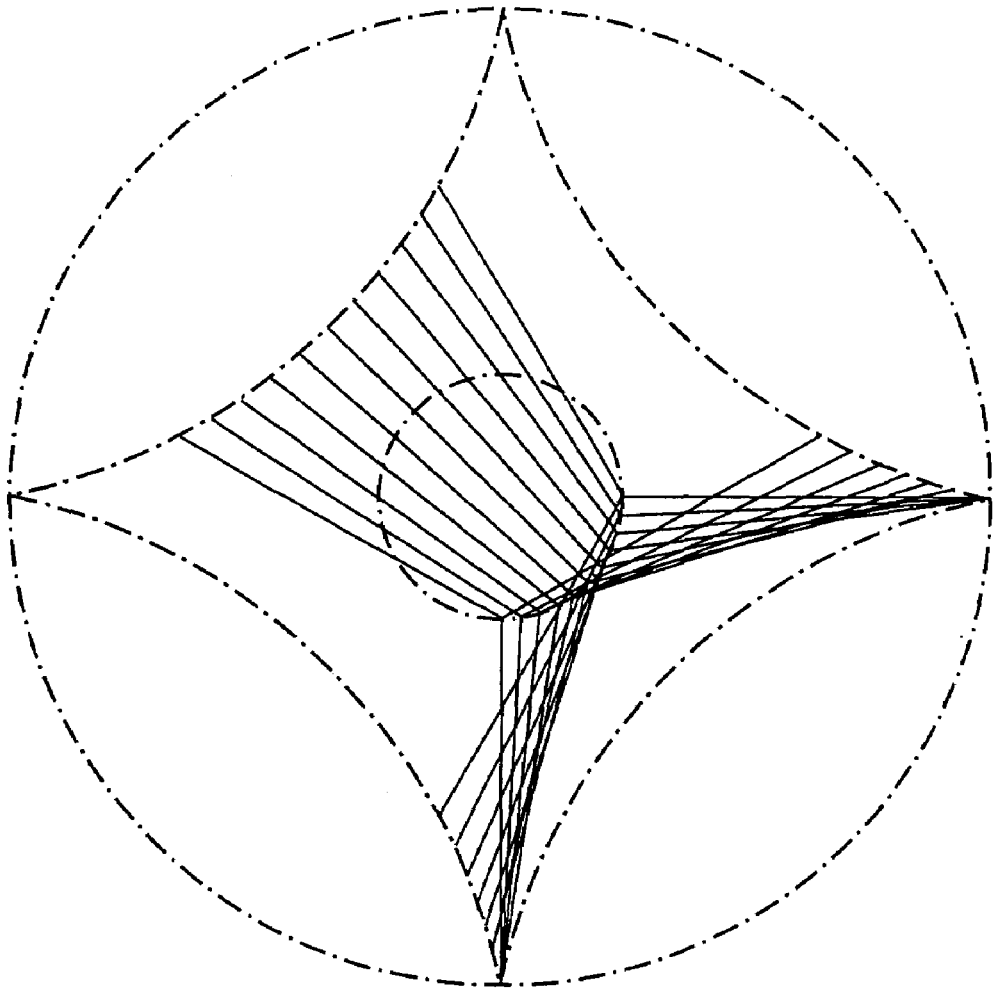
FIGS. 13A–C are schematic charts illustrating movements of rotary feeders employing different numbers of heads and illustrating example relative dimensions of components thereof.
Figure 13B:
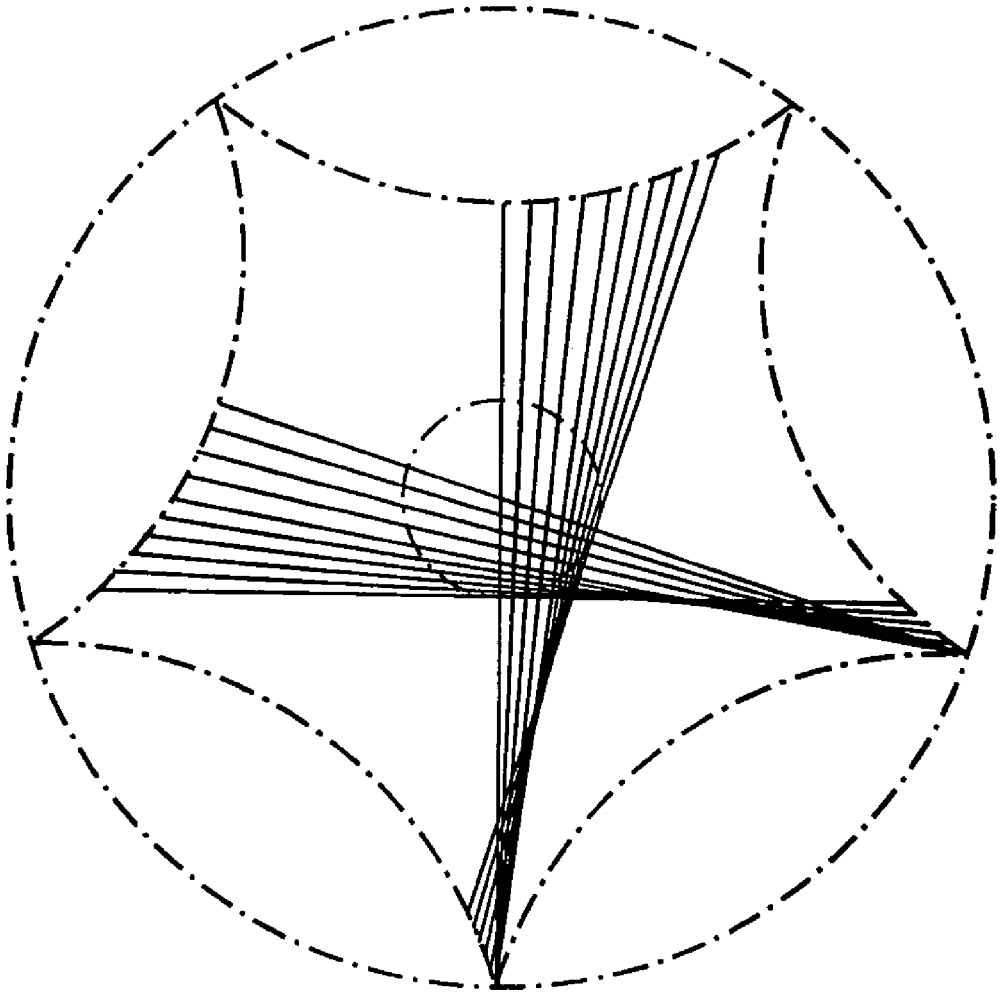
Figure 13C:
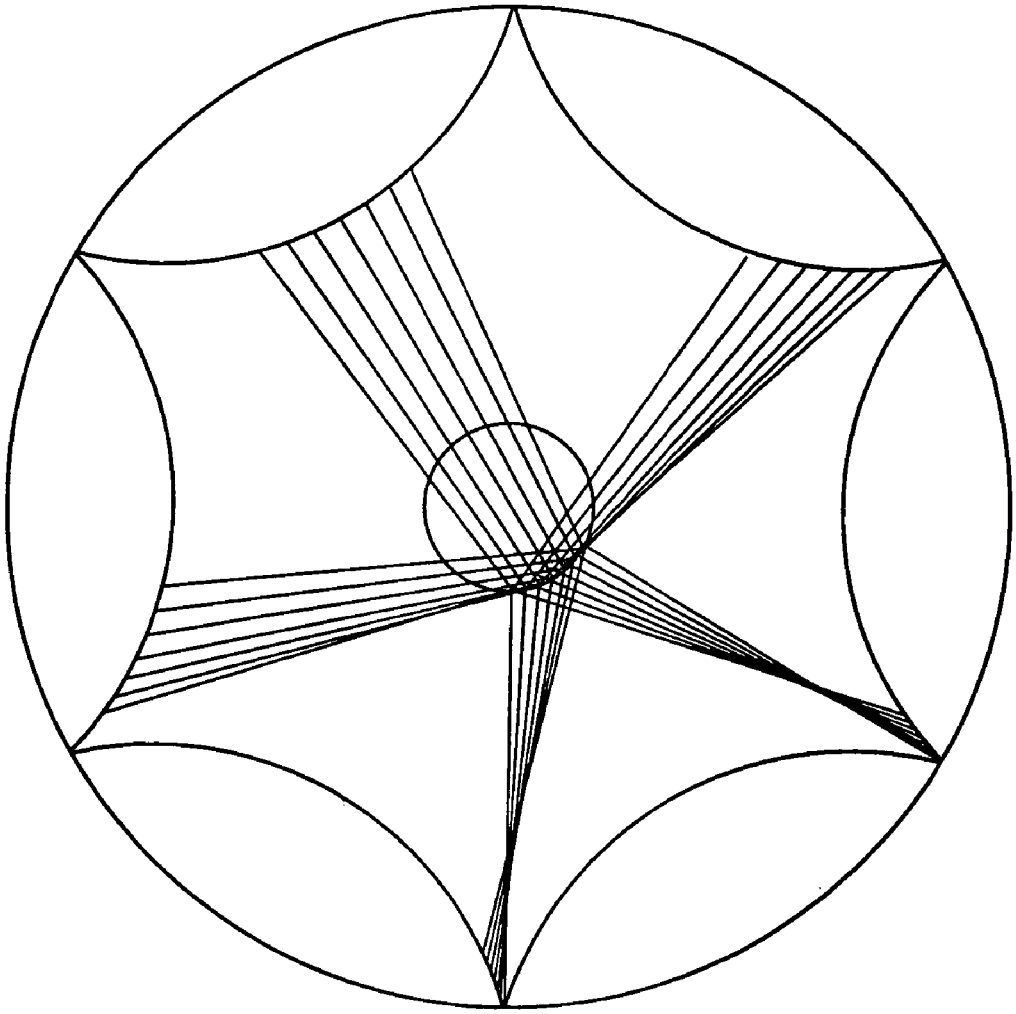

Finally, with reference by way of example to FIGS. 13A–*c*, the distance L (maximum radial extent of the distance from planetary axis Z—Z to the leading edge of the suction cups) equals N times the distance R (the distance from the sun axis X—X to the planetary axis Z—Z)

Figure 12A:
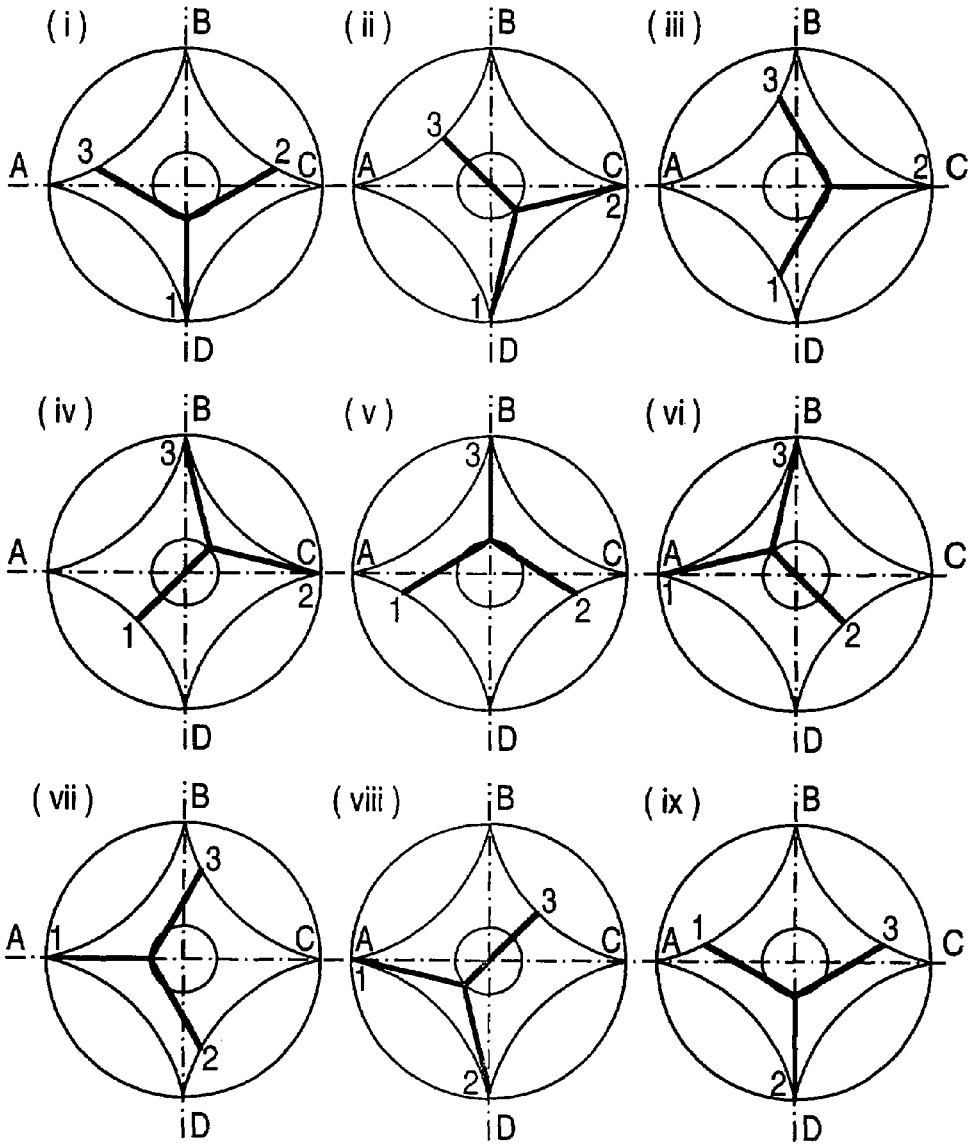
FIGS. 12A–D are schematic charts illustrating the sequential movements of rotary feeders employing different numbers of heads, in accordance with different embodiments of the invention.

By way of example, in FIG. 12A, the path of a three-head feeder passing through four path apexes identified as A, B, C, D is shown in increments of 45 degrees of rotation of the sun shaft 24 around the sun axis X—X. This 4 apex path shape is created when the rotational speed W3 of planetary shaft 36 is equal in magnitude to (4/3) times the rotational speed W1 of the sun shaft 24 and is opposite in direction. Each of the heads 1, 2 and 3, follows the same path, but each is out of phase with the others. In FIG. 12A, head 1 is shown initially in the first position i at apex D and at position ii, the planetary shaft 36 and the hub 82 of suction wheel 14 has moved 45 degrees about sun axis X—X in an anti-clockwise direction, but head 1, by virtue of the rotation in the opposite direction of planetary shaft 36 on its axis Z—Z and thus hub 82, has moved only a short angular distance from apex D. By position iii, planetary shaft 36 and hub 82 have moved another 45 degrees in an anti-clockwise direction, and head 1 has started to move more clearly in angular distance along the path in a clockwise direction towards apex A. This sequential movement continues through positions iv and v until at position vi, head 1 has almost reached apex A. By position vii head 1 is fully positioned at apex A and then by position viii, head 1 has started to move away from apex A. As shown at position ix, planetary shaft 36 and hub 82 have completed one full rotation orbiting around sun axis X—X, and head 1 is on its way along the path to apex B having rotated 120 degrees absolutely relative to its start position in a clockwise direction. It will take another two full rotational orbits of planetary shaft 36 and wheel hub 82 about sun axis X—X for head 1 to return to the position shown in position i in FIG. 12A.

It will be noted that at position ix, head 2 has now taken the position that head 1 took at apex D when head 1 initially started its movement. During the movement of all of the heads 1, 2 and 3 from the position shown in i to the position shown in ix, there will have been one full rotation of the planetary shaft 36 and hub 82 around sun axis X—X in a counterclockwise direction. At the same time, head 1 will have moved from apex D to apex A and then started its movement towards apex B. If the sequence of movement continues, head 1 will eventually pass to apex B then to apex C and then return to apex D. Although out of phase from head 1, it can be seen that head 2 at position iii starts at apex C and by position ix has reached apex D. Head 3 follows the same path but is out of phase with the other heads 1 and 2.

The overall result is a common cyclical path for each of the three heads 1, 2 and 3, with each head eventually passing through each of the four apexes A, B, C and D.

Figure 12B:
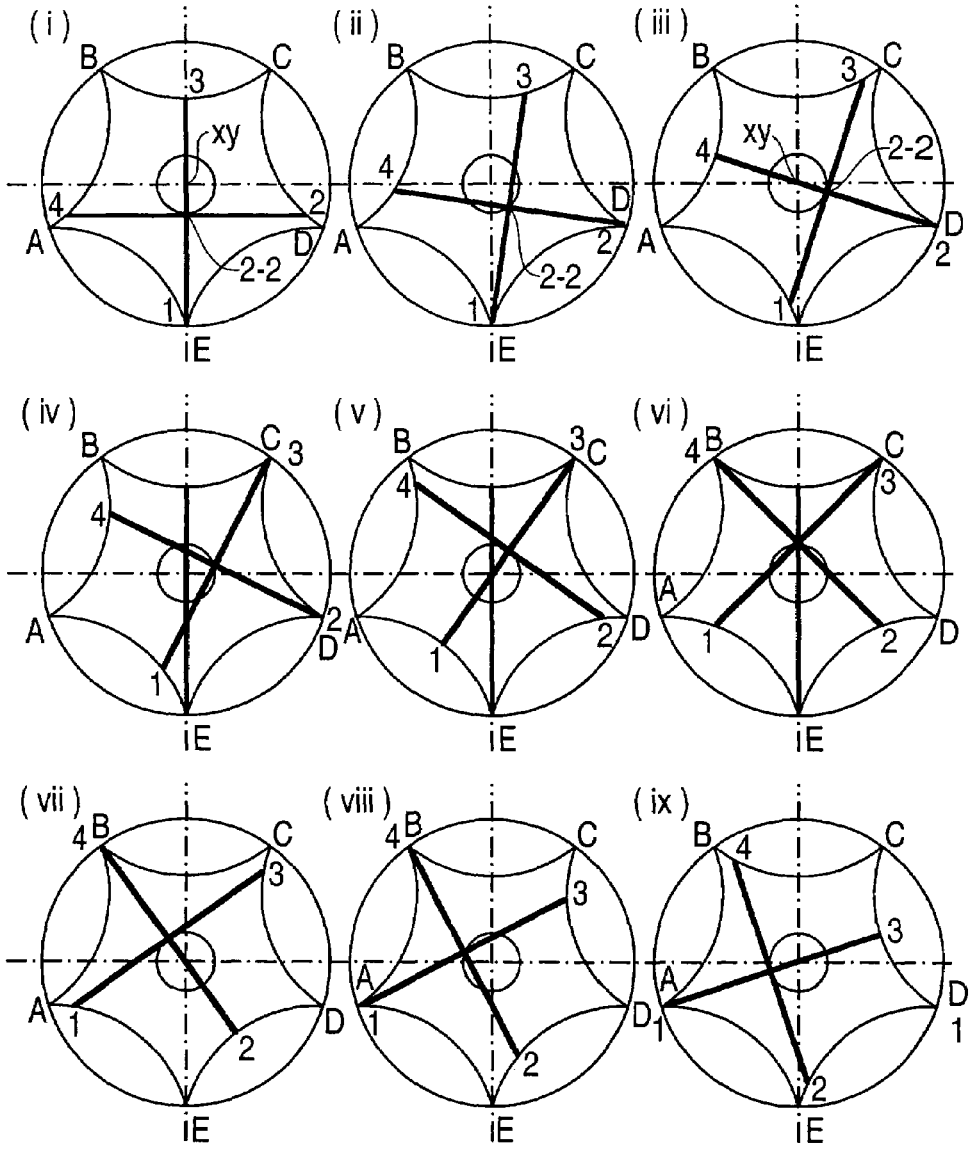
Figure 12B:
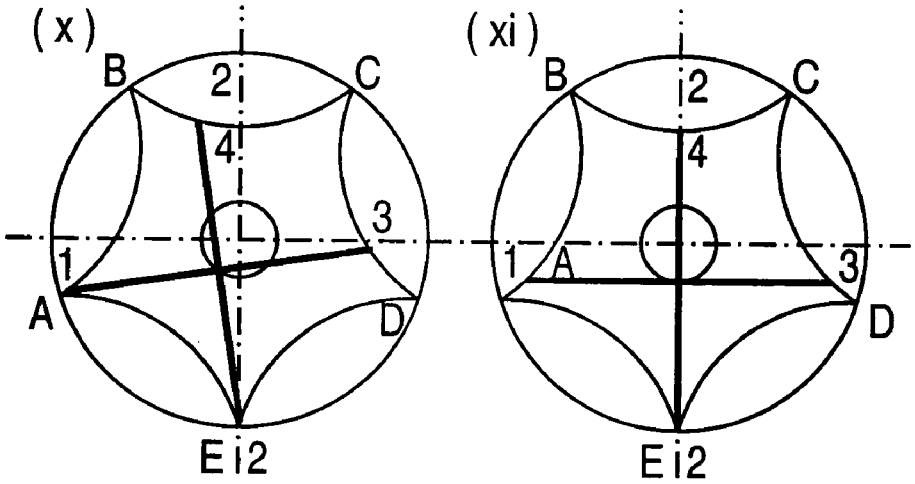

In FIG. 12B, the path of a four-head feeder passing through five path apexes identified as A, B, C, D, E is shown in increments of 36 degrees of rotation of the suction wheel 14 and its heads around the axis X—X. This 5 apex path shape is created when the rotational speed W3 of planetary shaft 36 about its axis Z—Z is equal in magnitude to (5/4) times the rotational speed W1 of the sun shaft 24 about its axis X—X and is opposite in direction. Each of the heads 1, 2, 3 and 4 follows the same path, but each is out of phase with the others. In FIG. 12B, head 1 is shown initially in the first position i at apex E and at position ii, the planetary shaft 36 and the hub 82 of suction wheel 14 has moved 36 degrees in an anti-clockwise direction, but head 1, by virtue of the rotation in the opposite direction of shaft 36 on its axis Z—Z, appears to have moved only a short angular distance from apex E. By position iii, planetary axis has moved another 36 degrees in an anti-clockwise direction, and head 1 has started to move in an angular distance along the path in a clockwise direction towards apex A. This sequential movement is shown as it continues in 36 degree increments through positions iv, v, vi, vii until at position viii, head 1 has almost reached apex A. By position ix head 1 is fully positioned at apex A and then by position xi, head 1 has started to move away from apex A. As shown at position xi, planetary shaft 36 and hub 82 have completed one full rotation around sun axis X—X, and head 1 is on its way along the path to apex B having rotated 90 degrees absolutely relative to its start position in a clockwise direction. It will take another three full rotations of planetary shaft 36 and wheel hub 82 about sun axis X—X for head 1 to return to the position shown in position i in FIG. 12B.

It will be noted that at position xi, head 2 has now taken the position that head 1 took at apex E when head 1 initially started its movement. During the movement of all of the heads 1, 2, 3, and 4 from the position shown in i to the position shown in xi, there will have been one full rotation of the planetary shaft 36 and hub 82 around sun axis X—X in a counterclockwise direction. At the same time, head 1 will have moved from apex E to apex A and then started its movement towards apex B. If the sequence of movement continues, head 1 will eventually pass to apex B then to apex C, to apex D and then return to apex E. The overall result is a cyclical path for each of the four heads 1, 2, 3 and 4 with each head eventually passing through each of the apexes A, B, C D and E.

Figure 12C:
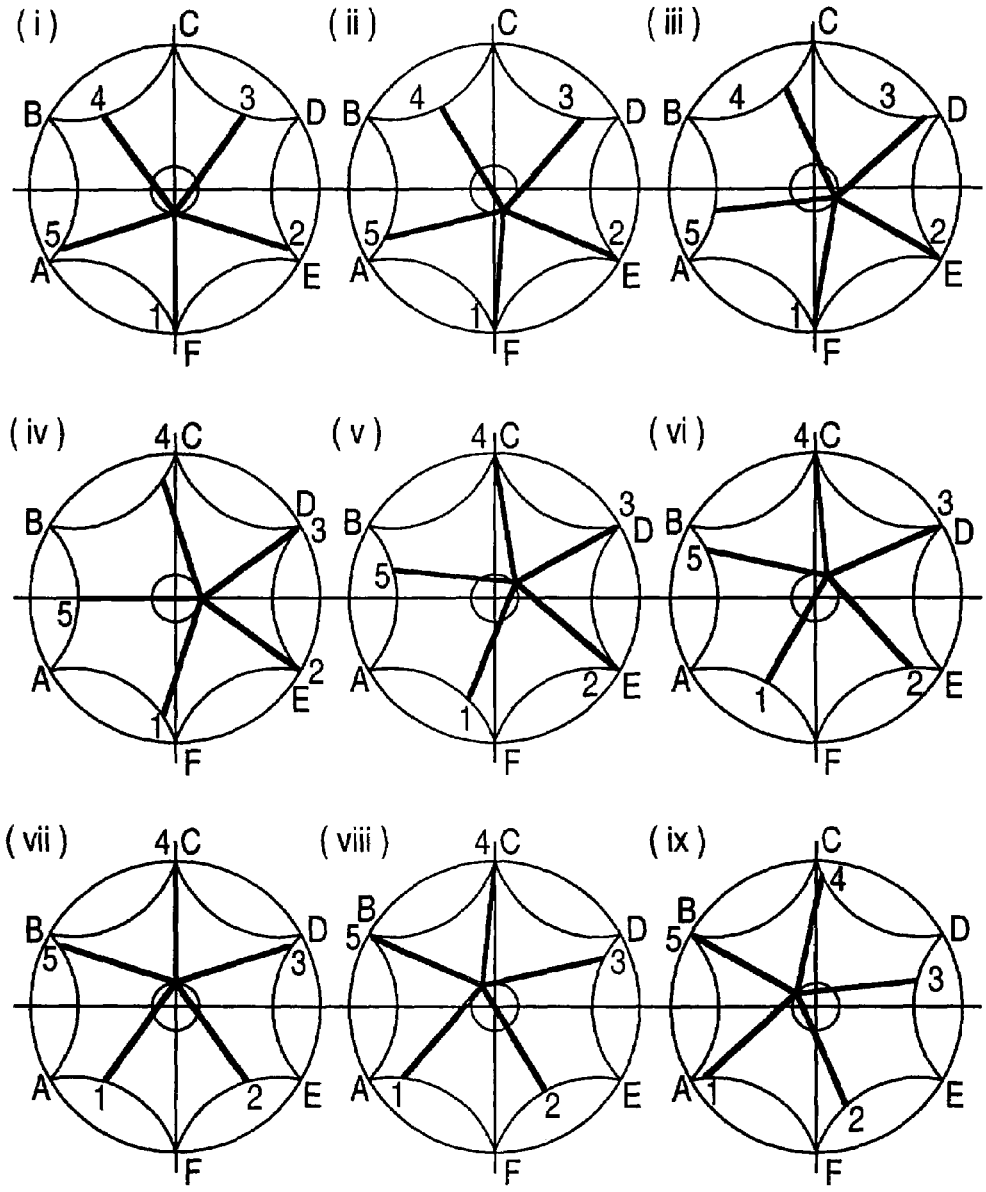
Figure 12C:
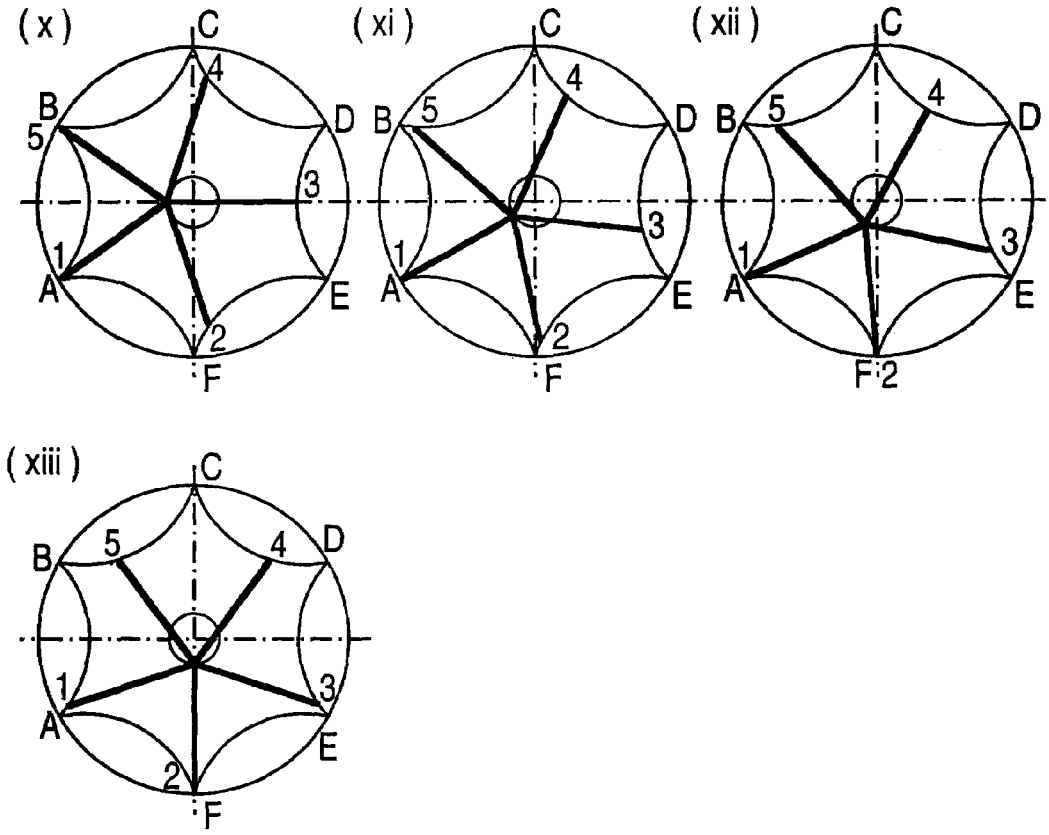

In FIG. 12C, the path of a five head feeder (like the feeder of FIG. 1-10) is shown passing through six path apexes identified as A, B, C, D, E, F in increments of 30 degrees of rotation of planetary shaft 36 and hub 82 around sun axis X—X. This 6 apex path shape is created when the rotational speed W3 of planetary shaft 36 is equal in magnitude to (6/5) times the rotational speed W1 of the sun shaft 24 and is opposite in direction. Each of the heads 1, 2, 3, 4 and 5 follows the same path, but each is out of phase with the others. In FIG. 12C, head 1 is shown initially in the first position i at apex F and at position ii, the planetary shaft 36 and the hub 82 of suction wheel 14 have moved 30 degrees in an anti-clockwise direction around sun axis X—X, but head 1, by virtue of the rotation in the opposite direction of shaft 36 on its axis, appear to have moved only a very short angular distance from apex E. By position iii, planetary shaft 36 and hub 82 have rotated in orbit another 30 degrees in an anti-clockwise direction around sun axis X—X, and head 1 has started to move in an angular distance along the path in a clockwise direction towards apex A. This sequential movement is shown as it continues in 30 degree increments through positions iv, v, vi, vii, viii until at position ix, head 1 has almost reached apex A. By position x head 1 is fully positioned at apex A and the rotation continues through positions xi and xii. By position xiii, head 1 has started to move away from apex A. As shown at position xiii, planetary shaft 36 and hub 82 have completed one full rotation around sun axis X—X, and head 1 is on its way along the path to apex B having rotated 72 degrees absolutely relative to its start position in a clockwise direction. It will take another four full rotations of planetary shaft 36 and wheel hub 82 about sun axis X—X for head 1 to return to the position shown in position i in FIG. 12C.

It will be noted that at position xiii, head 2 has now taken the position that head 1 took at apex F when head 1 initially started its movement. During the movement of all of the heads 1, 2, 3, 4 and 5 from the position shown in i to the position shown in xiii, there will have been one full rotation of the planetary shaft 36 and hub 82 orbiting around sun axis X—X in a counterclockwise direction. At the same time, head 1 will have moved from apex F to apex A and then started its movement towards apex B. If the sequence of movement continues, head 1 will eventually pass to apex B then to apex C, to apexes D and E and then return to apex F. The overall result is a cyclical path for each of the five heads 1, 2, 3, 4 and 5 with each head eventually passing through each of the apexes A, B, C, D, E and F.

Figure 12D:
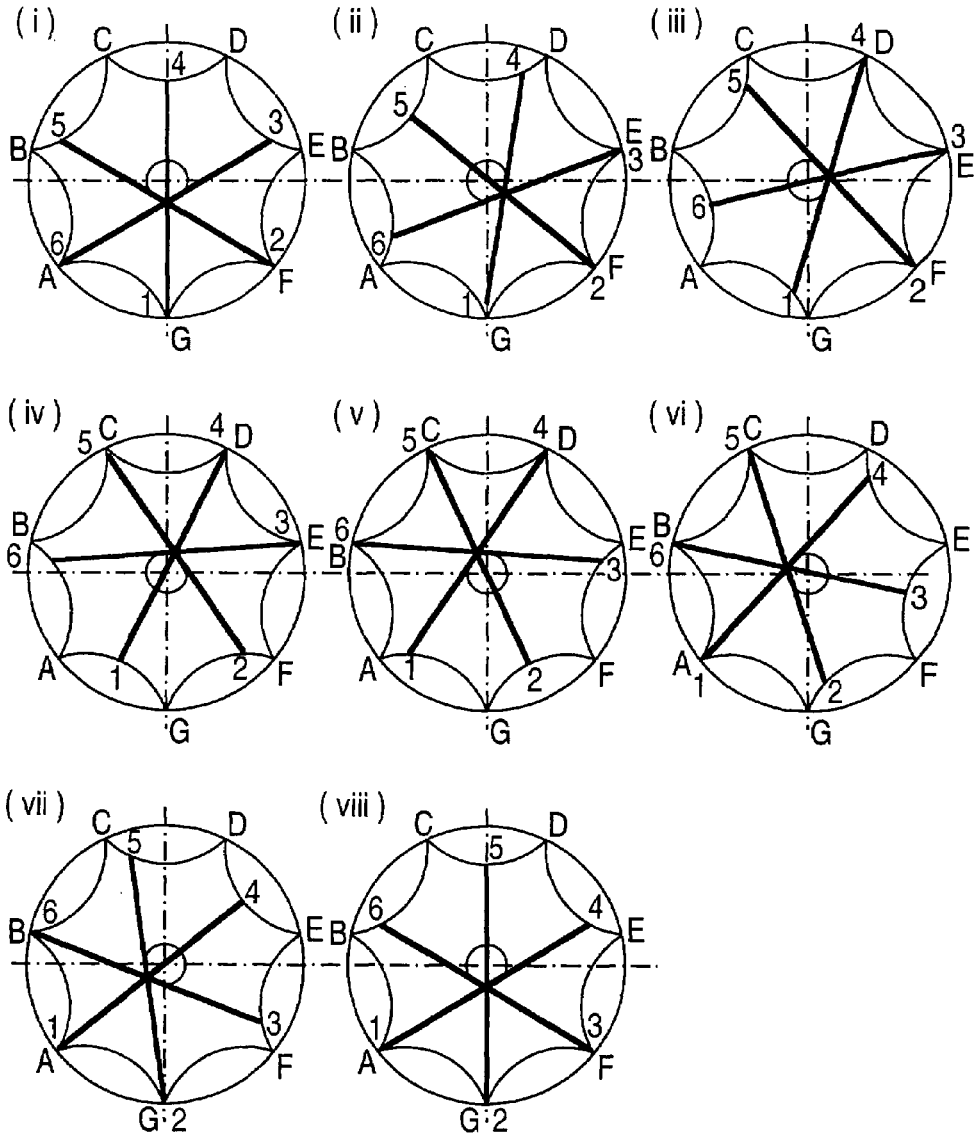

Finally, with reference to FIG. 12C, the path of a six head feeder is shown passing through seven path apexes identified as A, B, C, D, E, F, G in increments of (360/7) degrees of rotation of planetary shaft 36 and hub 82 around sun axis X—X. This 7 apex path shape is created when the rotational speed W3 of planetary shaft 36 is equal in magnitude to (7/6) times the rotational speed W1 of the sun shaft 24 and is opposite in direction. Each of the heads 1, 2, 3, 4, 5 and 6 follows the same path, but each is out of phase with the others. In FIG. 12C, head 1 is shown initially in the first position i at apex G and at position ii, the planetary shaft 36 and the hub 82 of suction wheel 14 have moved about 51.4 degrees in an anti-clockwise direction around sun axis X—X, but head 1, by virtue of the rotation in the opposite direction of shaft 36 on its axis, appear to have moved only a very short angular distance from apex G. By position iii, planetary shaft 36 and hub 82 have rotated in orbit another angular increment in an anti-clockwise direction around sun axis X—X, and head 1 has started to move in an angular distance along the path in a clockwise direction towards apex A. This sequential movement is shown as it continues in the same angular increments through position iv, v, until at position vi, head 1 has almost reached apex A. By position vii head 1 is fully positioned at apex A and the rotation continues through to position viii, by which planetary shaft 36 and hub 82 have completed one full rotation around sun axis X—X, and head 1 is on its way along the path to apex B having rotated 60 degrees absolutely relative to its start position in a clockwise direction. It will take another five full rotations of planetary shaft 36 and wheel hub 82 about sun axis X—X for head 1 to return to the position shown in position i in FIG. 12D.

It will be noted that at position viii, head 2 has now taken the position that head 1 took at apex G when head 1 initially started its movement. During the movement of all of the heads 1, 2, 3, 4, 5 and 6 from the position shown in i to the position shown in viii, there will have been one full rotation of the planetary shaft 36 and hub 82 orbiting around sun axis X—X in a counterclockwise direction. At the same time, head 1 will have moved from apex G to apex A and then started its movement towards apex B. If the sequence of movement continues, head 1 will eventually pass to apex B then to apex C, to apexes D, E and F and then return to apex G. The overall result is a cyclical path for each of the six heads 1, 2, 3, 4, 5 and 6 with each head eventually passing through each of the apexes A, B, C, D, E, F and G.

It has also been determined, as referenced above, that in order for the paths of the suction cups to properly conform to the desired paths shown in FIGS. 12A–*d*, it is also necessary to ensure the distance L (maximum radial extent of the distance from, planetary axis Z—Z to the leading edge of the suction cups) is substantially equal to N times the distance R (the distance from the sun axis X—X to the planetary axis Z—Z). In FIGS. 13A–*c*, examples of appropriate dimensions for each of the feeders of FIGS. 12A–*c* and their paths, are illustrated.

Figure 14:
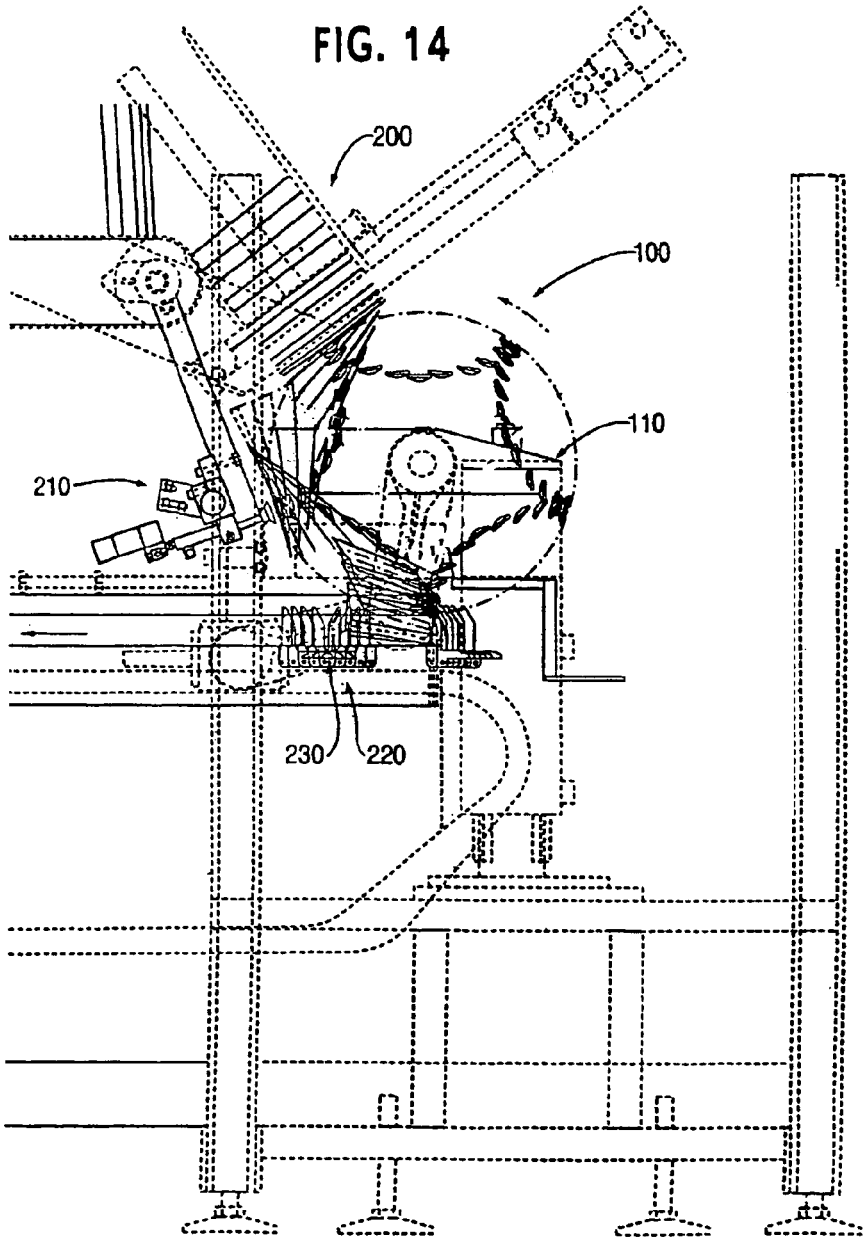
FIG. 14 is a side view of part of a conveyor system employing a rotary feeder which is an alternate embodiment to the feeder of FIG. 1 as a carton feeder.

Finally with reference to FIG. 14, an example of a four head, five apex feeder such as is referenced in FIGS. 12B and 13B, is shown implemented into a carton conveyor system 100. System 100 employs a feeder 110 in conjunction with a carton magazine 200, a carton opening or pre-break device 210 and a carton conveyor having carton receiving receptacles 230. It will be noted that with reference also to FIG. 12B, carton magazine 200 may be installed at or about apex B, the carton opener at apex A, and the carton receptacles can be configured to receive cartons from feeder 110 at apex E. By employing a four head feeder with a five apex path, the three main components of the carton magazine, the carton opener and the conveyor receptacle location, can all be positioned toward one side (i.e. Apexes E, A and B) with the apex E at which the carton is released into the receptacle being positioned at approximately 6 o'clock. This provides operational and maintenance advantages. Also, the four head feeder is constructed using a very efficient drive mechanism to produce this five apex path.

Any one of the feeders described above can be implemented into a system such as for example the carton conveyor feeder system of FIG. 14. When the heads of a particular feeder are in turn rotated by the mechanisms described above, around the paths illustrated and described above, the valves can turn the suction cups on and off at the appropriate locations so as to retrieve, hold and release objects, such as cartons, as desired.

It will be understood that the invention is not limited to the illustrations described and shown herein, which are deemed to be merely illustrative embodiments of the invention, and which are susceptible to modification of form, size, arrangement of parts and details of operation. The invention, rather, is intended to encompass all such-modifications which are within the scope as defined by the claims.

What is claimed:

1. A rotary object feeder comprising:

(a) a sun member having a sun axis and being rotatable about a sun axis of rotation;

(b) a sun drive mechanism for driving said sun member in rotation about said sun axis at a rotational speed of W1;

(c) a planetary member mounted for connection to said sun member, said planetary member having a planetary axis located at a constant distance X from said sun axis, said planetary axis being substantially parallel to said sun axis, said planetary member being rotatable about said planetary axis of rotation and also being mounted for rotation around said sun axis with said sun member;

(d) a planetary drive mechanism for rotating said planetary member about said planetary axis at a rotational speed of W3 which is opposite in direction to W1;

(e) N pick-up members mounted on said planetary member, where N is an integer greater than or equal to 3, said pick-up members having pick-up locations at a common radius from said planetary axis, said pick up members being rotatable with said planetary member about said planetary axis and rotating with said planetary member around said sun axis, each of said pick-up members for picking up, holding and releasing an object at respective pick-up locations, each said pick-up location on said pick-up member being a fixed distance equal to L from said planetary axis;

said pick-up members being driven about said planetary axis and said sun axis such that said pick-up locations of said pick-up members follow a common cyclical path having M apexes, wherein M=(N+1), and W3 is equal in magnitude to (M/N)×W1.

2. A rotary feeder as claimed in claim 1 wherein W1 and W3 are constant during a cycle of said pick-up members through M apexes of said common cyclical path.

3. A rotary object feeder as claimed in claim 2 further comprising a housing fixedly mounted to said sun shaft and wherein said planetary member is mounted to said housing, said planetary member being rotatable with said housing around said sun axis when said sun member is rotated about said sun axis.

4. A rotary object feeder as claimed in claim 3 wherein the distance L=N*X.

5. A rotary object feeder as claimed in claim 2 wherein the distance L=N*X.

6. A rotary feeder as claimed in claim 1 wherein W1 and W3 vary during a cycle of said pick-up members through M apexes of said common cyclical path.

7. A rotary feeder as claimed in claim 6 wherein said planetary member is a planetary shaft mounted for rotation about said planetary axis on said housing.

8. A rotary object feeder as claimed in claim 6 wherein the distance L=N*X.

9. A rotary feeder as claimed in claim 1 wherein said sun member is a sun shaft rotatable about said sun axis that passes through its length.

10. A rotary object feeder as claimed in claim 9 wherein the distance L=N*X.

11. A rotary object feeder as claimed in claim 1 wherein the distance L=N*X.

12. A rotary object feeder as claimed in claim 11 wherein N=3.

13. A rotary object feeder as claimed in claim 11 wherein N=4.

14. A rotary object feeder as claimed in claim 11 wherein N=5.

15. A rotary object feeder as claimed in claim 11 wherein N=6.

16. A rotary object feeder as claimed in claim 11 further comprising an idler shaft mounted to said housing, said idler shaft having and being rotatable about an idler axis spaced from said sun axis and said planetary axis, said idler axis being substantially parallel to said sun axis, said idler shaft rotating around said sun axis with said housing and said planetary shaft, said idler shaft having a first idler pulley fixedly attached thereto and rotatable with said idler shaft, and wherein said sun shaft has a first sun pulley fixedly attached thereto and which is rotatable with said sun shaft, said sun pulley being interconnected to said idler shaft such that rotation of said housing and said idler shaft about said sun axis, causes said sun pulley to rotate said idler shaft about said idler axis.

17. A rotary object feeder as claimed in claim 16 wherein said idler shaft has a second idler pulley fixedly attached thereto and is rotatable with said idler shaft, said planetary shaft also having a planetary pulley fixedly attached thereto and which is rotatable with said planetary shaft about said planetary axis, said planetary pulley being interconnected to said second idler pulley such that rotation of said idler shaft, causes said second idler pulley to rotate said planetary pulley and said planetary shaft about said planetary axis, thereby rotating said pick-up members about said planetary axis.

18. A rotary object feeder as claimed in claim 17 wherein said pick-up locations are equally angularly spaced about said planetary axis.

19. A rotary object feeder as claimed in claim 17 wherein each of said pick-up members has at least one suction cup for picking up, holding and releasing an object, at said respective pick-up location, and further comprising an apparatus for delivering an air suction force to each of said at least one suction cup.

20. A rotary object feeder as claimed in 19 wherein each of said apparatus for delivering an air suction force to each said at least one suction cup comprises a vacuum generator having an inlet supplied with pressurized air and an outlet interconnected through a conduit to said at least one suction cup for generating said air suction force.

21. A rotary feeder as claimed in claim 20 further comprising a valve stack arrangement, said valve stack having an inlet receiving pressurized air through a valve stack inlet conduit, and said valve stack having a plurality of outlets providing pressurized air to a plurality of valve stack outlet conduits interconnected to each said vacuum generator of each said pick-up members, said valve stack being operable to independently turn on and off the flow of pressurized air to each of said plurality of outlets.

22. A rotary feeder as claimed in claim 21 further comprising a programmable logic controller interconnected to said valve stack for controlling the flow of pressurzied air to each of said plurality of conduits, whereby the air suction force at each of said suction cups can be turned on and off by said programmable logic controller.

23. A rotary object feeder as claimed in claim 1 wherein N=3.

24. A rotary object feeder as claimed in claim 1 wherein N=4.

25. A rotary object feeder as claimed in claim 1 wherein N=5.

26. A rotary object feeder as claimed in claim 1 wherein N=6.

27. A rotary object feeder as claimed in claim 1 wherein said pick-up locations are equally angularly spaced about said planetary axis.

28. A rotary object feeder as claimed in claim 1 wherein each of said pick-up members has at least one suction cup for picking up, holding and releasing an object at said respective pick-up location, and further comprising an apparatus for delivering air suction force to each of said at least one suction cup.

29. A rotary feeder as claimed in claim 1 further wherein said pick up members are mountd to a pick-up hub fixedly mounted on said planetary member for rotation with said planetary member about said planetary axis and said pick-up hub has a plurality of arm members extending radially from said central hub, each of said arm members having one of said N pick-up members mounted thereon.

* * * * *